US005865088A

United States Patent [19]

Nakabayashi et al.

[11] Patent Number: 5,865,088

[45] Date of Patent: Feb. 2, 1999

[54] HIGH-SPEED SAFETY CIRCUIT FOR A HYDRAULIC PRESS

[75] Inventors: Hideaki Nakabayashi; Hitoshi Sawamura, both of Ishikawa-ken, Japan

[73] Assignees: Komatsu Ltd.; Komatsu Industries Corporation, both of Tokyo, Japan

[21] Appl. No.: 981,753

[22] PCT Filed: Jul. 18, 1996

[86] PCT No.: PCT/JP96/02009

§ 371 Date: Dec. 31, 1997

§ 102(e) Date: Dec. 31, 1997

[87] PCT Pub. No.: WO97/04951

PCT Pub. Date: Feb. 13, 1997

[30] Foreign Application Priority Data

Jul. 25, 1995 [JP] Japan ..... 7/189383

[51] Int. Cl.[6] ..... F15B 11/00

[52] U.S. Cl. ..... 91/509; 91/421; 91/519; 60/560

[58] Field of Search ..... 91/421, 435, 458, 91/509, 519; 60/560; 92/152

[56] References Cited

U.S. PATENT DOCUMENTS

| | | | |
|---|---|---|---|
| 2,822,822 | 2/1958 | Pinsenschaum | 91/421 X |
| 3,877,346 | 4/1975 | Koopmann et al. | 91/509 |
| 4,630,442 | 12/1986 | Massaro et al. | 91/519 X |
| 4,685,295 | 8/1987 | Christiansen et al. | 91/421 X |
| 4,805,515 | 2/1989 | Kast | 91/509 X |

FOREIGN PATENT DOCUMENTS

| | | |
|---|---|---|
| 55-81100 | 6/1980 | Japan . |
| 56-18200 | 2/1981 | Japan . |
| 2-18801 | 5/1990 | Japan . |
| 6-39285 | 5/1994 | Japan . |
| 6-155089 | 6/1994 | Japan . |

*Primary Examiner*—Hoang Nguyen
*Attorney, Agent, or Firm*—Frishauf, Holtz, Goodman, Langer & Chick

[57] ABSTRACT

A high speed safety circuit arrangement is provided for a hydraulic press which is driven by a hydraulic cylinder assembly constituted by a principal cylinder unit and a subsidiary cylinder unit. The circuit arrangement comprises a servo valve disposed in one of at least a pair of conduit lines for supplying a pressure fluid from a source thereof into the principal cylinder unit and the subsidiary cylinder unit, a first logic valve disposed in the other of the conduit lines and switched on and off and by the servo valve and a first electromagnetic valve for opening and closing that other conduit line, a second and a third logic valve of which each is switched on and off, and at least one is selectively actuatable, by a second electromagnetic valve to interconnect an upper and a lower chamber of the principal cylinder unit in a hydraulic circuit.

5 Claims, 15 Drawing Sheets

HIGH-SPEED SAFETY CIRCUIT FOR A HYDRAULIC PRESS

TECHNICAL FIELD

The present invention relates to a high speed safety circuit arrangement for a hydraulic press.

BACKGROUND ART

There have hitherto been known certain hydraulic circuit arrangements for a hydraulic press in which a slide is vertically driven up and down by a hydraulic cylinder assembly, as disclosed, for example, in Japanese Examined Utility Model Publication No. Hei 2-18801, Japanese Unexamined Utility Model Publication No. Hei 6-39285 and Japanese Unexamined Patent Publication No. Hei 6-155089.

In particular, Japanese Examined Utility Model Publication No. Hei 2-18801 has described a fluid pressure control circuit arrangement having a construction in which a circuit for supplying a pressure fluid into a hydraulic cylinder assembly is provided with a directional control valve and a pilot check valve such that by switching the directional control valve so as to allow the fluid pressure to be applied via the check valve to the hydraulic cylinder assembly, the latter may act to drive any particular load operatively associated therewith.

Also, Japanese Unexamined Utility Model Publication No. Hei 6-39285 has specifically disclosed a hydraulic circuit arrangement for a press in which the cylinder assembly is constructed to include a pressure cylinder unit having a larger pressure receiving area and a subsidiary cylinder unit having a smaller pressure receiving area but operable at a higher speed, the two cylinder units being arranged on a common center line. And, there a construction is employed in which the respective pistons of the two cylinder units are coupled together by a piston rod in the two rod cylinder assembly with the piston rod in the high speed cylinder unit projecting upwards thereof.

And, the system is so configured that after the high speed cylinder unit is supplied with the pressure fluid so as to allow its piston to be driven at a higher speed, the pressure cylinder unit may be supplied with the pressure fluid to allow a larger pressing force to be derived so as to be capable of meeting with a greater load.

Further, a specific hydraulic system as disclosed in Japanese Unexamined Patent Publication No. Hei 6-155089 has also adopted a cylinder assembly constituted of a high speed cylinder unit and a pressure cylinder unit. In this specific arrangement there is provided at the side of the piston in the pressure cylinder unit a sequence valve that is adapted to be opened and closed by using a pilot pressure.

And, the system specifically disclosed there is so configured that by permitting the sequence valve to be switched on and off, a high speed operation may be switched to a pressing operation, thus being capable of meeting with a greater load at a higher speed without requiring a special piping unit or valves externally fitted.

With a fluid pressure control circuit arrangement as disclosed in Japanese Examined Utility Model Publication No. Hei 2-18801 it is noted, however, that where a dust is introduced onto a spool in the directional control valve so as to disturb its downward displacement the pressure fluid from the pressure cylinder may no longer be constricted, thus bringing about the inconvenience that there can arise the danger of an increased load.

With a hydraulic circuit arrangement as disclosed in Japanese Unexamined Utility Model Publication No. Hei 6-39285, it is also noted that a bite into a die may arise during a pressing operation while a large force of removal may not be obtained. There then arises an inconvenience that a pressed sheet may not be removed from its die bite.

It further is noted that with a high speed for a greater load cylinder assembly as disclosed in Japanese Unexamined Patent Publication No. Hei 6-155089 in which the sequence valve is provided internally of the piston in the pressure cylinder unit, not only is its maintainability poor but also there may be brought about a danger arising from the fact that the piston rod in the high speed cylinder unit is projecting upwards thereof.

With the above described problems taken into account it is an object of the present invention to provide a high speed safety circuit arrangement for a hydraulic press that is capable of permitting a slide to be driven and operated at an increased speed and yet with due safety.

SUMMARY OF THE INVENTION

In order to achieve the above mentioned object, there is provided a high speed safety circuit arrangement for a hydraulic press in which a slide is vertically driven by a hydraulic cylinder assembly constituted of a principal cylinder unit and a subsidiary cylinder unit which are arranged vertically down and up with a common center line therefor, the said principal cylinder unit having a pressure receiving area which is greater than that of the said subsidiary cylinder unit, and a piston in the said principal cylinder unit and a piston in the said subsidiary cylinder unit being connected together by a piston rod in the said subsidiary cylinder unit that is smaller in diameter than a piston rod in the said principal cylinder unit, which circuit arrangement comprises: a servo valve means disposed in one of at lest a pair of conduit lines for supplying a pressure fluid from a source thereof into said principal cylinder unit and said subsidiary cylinder unit, respectively, and operable to switch the direction in which the said pressure fluid is supplied; a first electromagnetic valve means; a first logic valve means disposed in the other of the said conduit lines and adapted to be switched on and off in response to an operation of the said servo valve means and the said first electromagnetic valve means; a second electro-magnetic valve means; and a second and a third logic valve means of which each is adapted to be switched on and off in response to an operation of the said second electromagnetic valve means and at least one is selectively actuatable thereby to interconnect an upper and a lower chamber of the said principal cylinder unit in a hydraulic circuit.

And, in the construction described above, it is desirable that there be further provided a third electromagnetic valve; and a first pilot check valve means disposed midway in a conduit line interconnecting the said pressure fluid source and the said servo valve means and adapted to be switched on and off in response to an operation of the said third electromagnetic valve means for opening and closing the last mentioned conduit line.

It is also desirable that there be further provided a fourth electromagnetic valve means for connecting the upper chamber in the said principal cylinder unit and an upper chamber in the said subsidiary cylinder unit with each other; a fifth electromagnetic valve means; and a second check valve means adapted to be switched on and off in response to the said fifth electromagnetic means for interconnecting the upper chamber of the said subsidiary cylinder unit and a fluid reservoir via the said second pilot check valve means.

According to a construction as described above, it may be seen that by permitting the pressure fluid to be supplied into the upper chamber and the lower chamber of the principal cylinder unit via the one conduit line by means of the servo valve means, the slide with the principal cylinder unit can be moved down at an increased speed owing to a difference in the pressure receiving area between the two chambers.

It may also be seen that during a given pressing operation, an increased pressing force can be obtained with the pressure fluid supplied into the upper chamber of the principal cylinder unit that has a larger pressure receiving area. Also, since while the slide is moving upwards a greater rising force therefor is attained with the pressure fluid supplied into both the respective lower chambers of the principal cylinder unit and the subsidiary cylinder unit, it may be seen that the upper pressing die can be detached readily from a pressed workpiece if the former were bitten into the latter.

Further, since a given electromagnetic valve means is provided for each conduit line independently of others, it may be seen that if any one comes into a failure during a given pressing operation, the other electromagnetic valves coupled with the servo valve means can effectively act to stop the pressing operation.

In a construction as described above, it should also be noted that the said logic valve means for interconnecting the upper and lower chambers of the principal cylinder unit in the hydraulic circuit can be constituted by the said second and third logic valve means together which are connected in series with each other and substantially of an identical size, and that the said second and third logic valve means can be switched on and off alternately in response to an operation of the said second electromagnetic means for effecting a pressure compensation in the said hydraulic circuit.

According to the construction described in the preceding paragraph, it may be seen that with the use of the said logic valve means which are connected in series with each other and of which one is designed for a pressure compensation as noted, it is also possible to prevent the pressure in a said cylinder unit from being suddenly elevated due to a volume change therein when the logic valves are operated.

Also, in a construction as described above, it may be noted that the said logic valve means for interconnecting the upper and lower chambers of the said principal cylinder unit can be constituted by said third logic valve means, and that there can further be a shuttle valve means for applying therethrough the pressure fluid as a back pressure medium to the said third logic valve means at a high pressure side thereof for effecting a pressure compensation in the said hydraulic circuit.

According to the construction described in the preceding paragraph, it may be seen that since the logic valve means for interconnecting the upper and lower chambers of the principal cylinder unit is utilized to receive a back pressure for effecting a pressure compensation as noted, any separate logic valve means that is specifically for such a pressure compensation can be effectively dispensed with.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to a high speed safety circuit arrangement for a hydraulic press will be set forth with reference to the accompanying drawings hereof.

An explanation will now be given of the first embodiment of the present invention with reference to FIGS. 1 through 5B.

Figure 1:
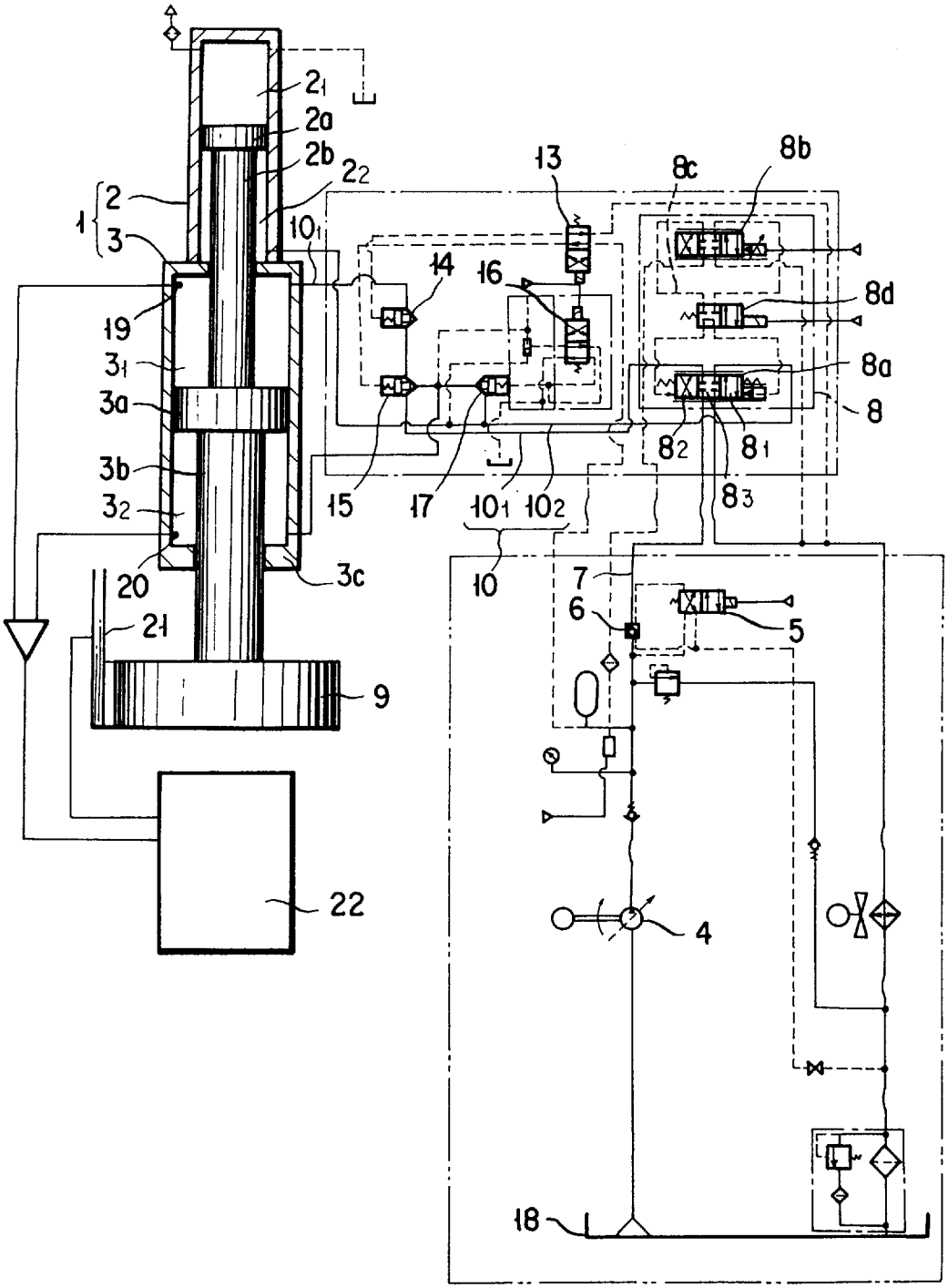
FIG. 1 is a circuit diagram that illustrates a first embodiment of the high speed safety circuit arrangement for a hydraulic press according to the present invention.

Referring first to FIG. 1, a hydraulic cylinder assembly 1 is shown as constituted of a principal cylinder unit 3 that has a larger pressure receiving area and a subsidiary cylinder unit 2 that has a smaller pressure receiving area.

The subsidiary cylinder unit 2 and the principal cylinder unit 3 which constitutes the hydraulic cylinder assembly 1 are provided vertically up and down on a common center line therefor. These cylinder units 2 and 3 have pistons 2*a* and 3*a* received therein, respectively.

The piston 2*a* received within the subsidiary cylinder unit 2 has a downwards projecting piston rod 2*b* attached to its lower surface and the piston rod 2*b* has its lower end attached to the upper surface of the piston 3*a* received within the principal cylinder unit 3 whereas the piston 3*a* within the principal cylinder unit 3 has its lower surface to which is attached a downwards projecting piston rod 3*b* that is greater in diameter than the above mentioned piston rod 2*b*. The piston rod 3*b* projecting downwards has its lower end penetrating out of the cylinder of the principal cylinder unit 3 through its lower end plate 3*c* and having attached thereto a press slide 9.

It can also be seen that a pressure fluid discharged from a fluid pressure source 4 which can be a variable flow rate hydraulic pump is delivered into a servo valve assembly 8 via a conduit line 7 in which a pilot check valve 6 is provided.

The servo valve assembly 8 comprises a main valve 8*a*, a pilot switching valve 8*b* that consists of an electromagnetic valve for switching under a pilot pressure, and an ON/OFF valve 8*d* that consists of an electromagnetic valve which is provided midway of a pilot circuit 8*c*.

And, a two line conduit system 10 for connecting the servo valve assembly 8 and the hydraulic cylinder assembly 1 with each other comprises a conduit line $\mathbf{10}_1$ that is connected to an upper chamber $\mathbf{3}_1$ of the principal cylinder unit 3 and the logic valve 5 via a pair of logic valves 15 and 14 which are alternately opened and closed with an electromagnetic valve 13, and a conduit line $\mathbf{10}_2$ that is connected to a lower chamber $\mathbf{2}_2$ of the subsidiary cylinder unit 2 and that is connectable to a lower chamber $\mathbf{3}_2$ of the principal cylinder unit 3 via a logic valve 17 which is opened and closed with an electromagnetic valve 16. It will also be noted that an upper chamber $\mathbf{2}_1$ of the subsidiary cylinder unit 2 is opened to the atmosphere.

On the other hand, the upper chamber $\mathbf{3}_1$ and the lower chamber $\mathbf{3}_2$ of the principal cylinder unit 3 are provided with sensing means 19 and 20, respectively, each of which consists of a pressure sensor and which are adapted to sense pressures within the chambers $\mathbf{3}_1$ , and $\mathbf{3}_2$, respectively, thereby to detect a pressing force P applied by the slide 9. In addition, there is provided in the vicinity of the slide 9 a further sensing means for detecting a position of the slide 9. Signals that are representative of the pressure and the position of the slide 9 are furnished to enter into a controller 22.

An explanation will next be given with respect to an operation of the high speed safety circuit arrangement for a press, that is constructed as noted above. In this regard, it should be noted that the word "ON" represents "open" or "opened" and the word "OFF" represents "close" or "closed".

In a case where the slide 9 is being allowed to descend from an upper dead point to initiate a given pressing operation, the pilot switching valve 8*b* and the ON/OFF valve 8*d* of the servo valve assembly 8 will be turned ON to switch the main valve 8*a* to its descending position $\mathbf{8}_1$ from its neutral position $\mathbf{8}_3$. At the same time, the pilot check valve 6 will be turned ON by the electromagnetic valve 5, the logic, valve 14 will be turned OFF and the logic valve 15 will be turned ON by the electromagnetic valve 13, and the logic valve 17 will be turned OFF by the electromagnetic valve 16.

Figure 2A:
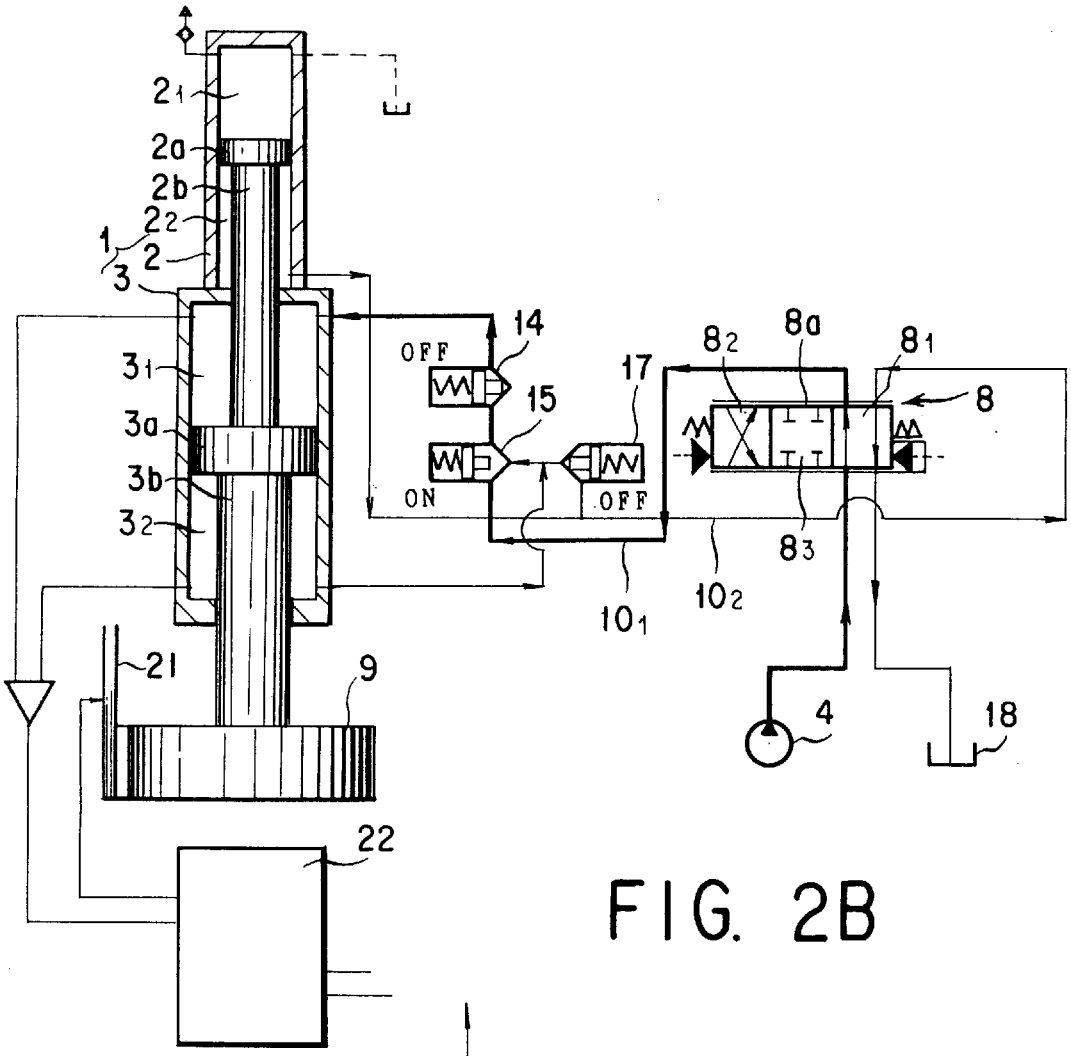
FIGS. 2A and 2B together represent an explanatory view that illustrates an operation in which the slide is allowed to descend at an increased speed according to the above noted first embodiment of the present invention.
Figure 2B:
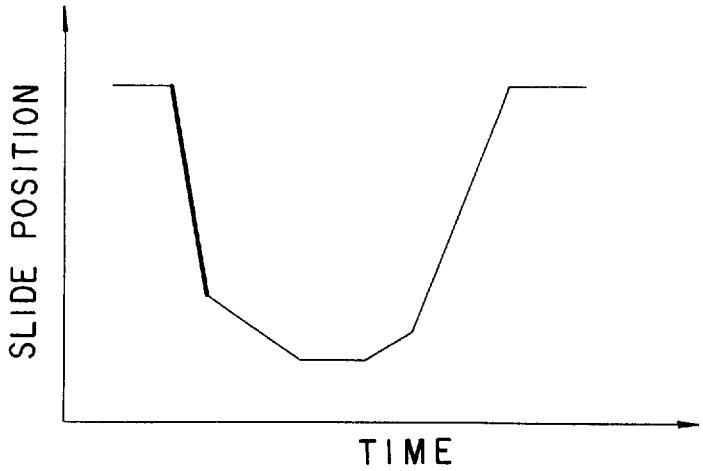

This will, as shown in FIG. 2A, cause the pressure fluid discharged from the fluid pressure source 4 to flow via the logic valves 15 and 14 through the conduit line $\mathbf{10}_1$ into the upper chamber $\mathbf{3}_1$ of the principal cylinder 3. Also, a fluid communication has been established between the upper chamber $\mathbf{3}_1$ and the lower chamber $\mathbf{3}_2$ via the logic valves 14 and 15. Accordingly the slide 9 will, as shown by the thick line in FIG. 2B, be lowered at a high speed owing to a difference in the pressure receiving area between the upper chamber $\mathbf{3}_1$ and the lower chamber $\mathbf{3}_2$ of the principal cylinder unit 3. The pressure fluid in the lower chamber $\mathbf{2}_2$ of the subsidiary cylinder unit 2 will then be drained through the conduit line $\mathbf{10}_2$ into a reservoir 18 via the servo valve assembly 8.

Next, in a case where the slide 9 has been moved down to a predetermined position and a pressing force is then required to form a workpiece, it should be noted that with the main valve 8*a* in the servo valve assembly 8 held at its descending position, the logic valve 14 will be turned ON and the logic valve 15 will be turned OFF by the electromagnetic valve 13 while the logic valve 17 will be turned ON by the electromagnetic valve 16.

Figure 3A:
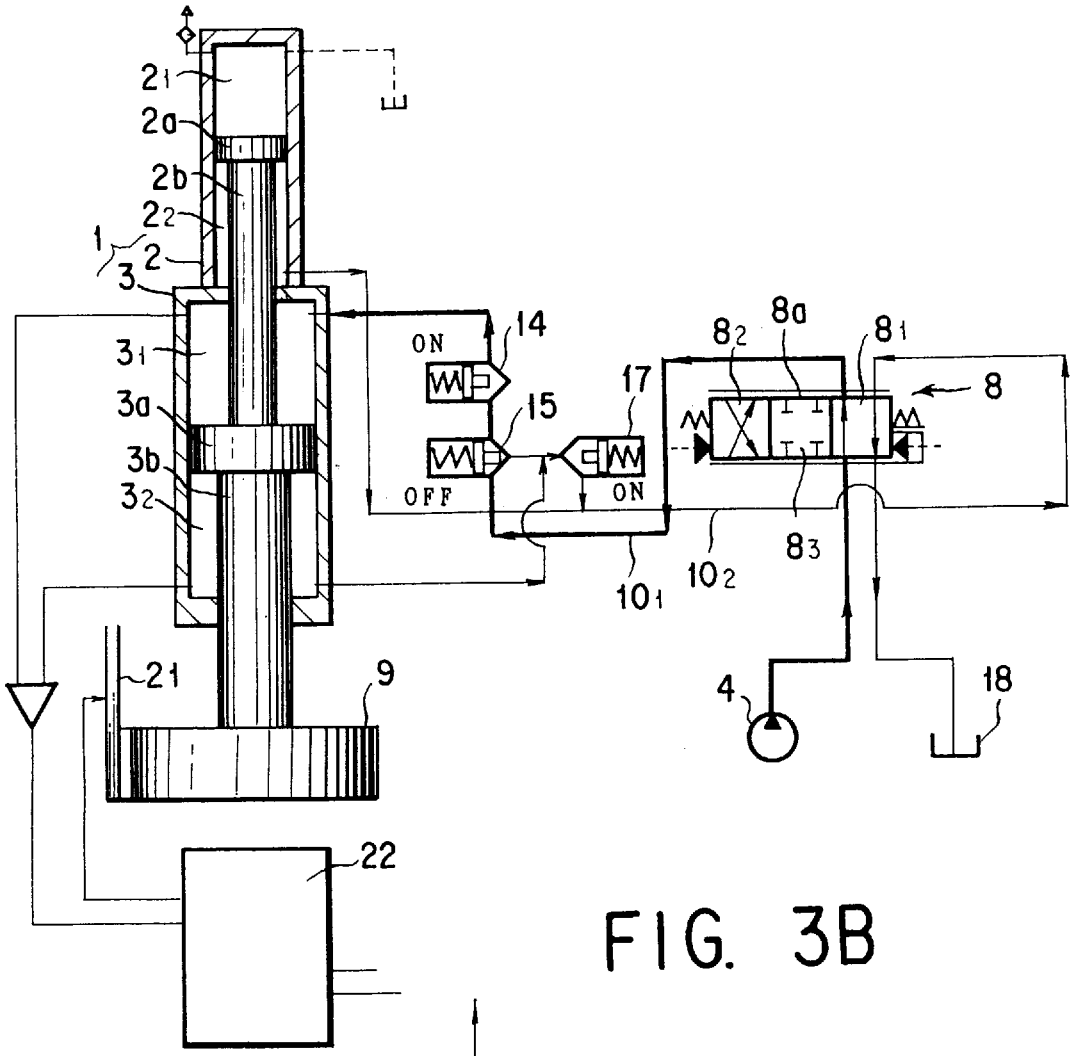
FIGS. 3A and 3B together represent an explanatory view that illustrates an operation in which the slide is allowed to descend at a reduced speed according to the above noted first embodiment of the present invention.
Figure 3B:
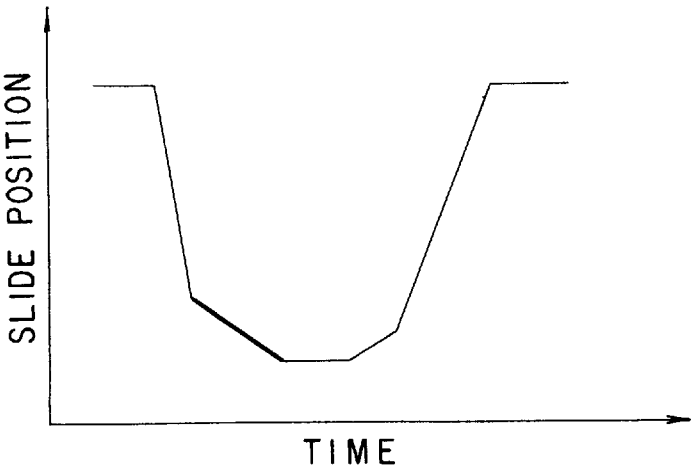

This will, as shown in FIG. 3A, cause the pressure fluid discharged from the fluid pressure source 4 to be supplied only into the upper chamber $\mathbf{3}_1$ of the principal cylinder unit 3, the pressure fluid in the lower chamber $\mathbf{3}_2$ of the principal cylinder unit 3 to flow out thereof via the logic valve 17 into the conduit line $\mathbf{10}_2$ and then along with the pressure fluid in the lower chamber $\mathbf{2}_2$ of the subsidiary cylinder $\mathbf{10}_2$ to be drained into the reservoir 18. As a result, the piston 3*a* will be pushed downwards under a pressure of the fluid in the upper chamber $\mathbf{3}_1$ of the principal cylinder unit 3 to cause the slide 9 to descend at a reduced speed as shown by the thick line in FIG. 3B. Then an increased pressing force will be produced to allow a workpiece to be formed between an upper die and a lower die (none of them shown) satisfactorily.

Also, in a case where the workpiece is required to be held in a pressurized state during a given forming operation, in the servo valve assembly 8 the main valve 8*a* will be switched to its neutral position $\mathbf{8}_3$ by the pilot switching valve 8*b*. Then, since the slide 9 is stationary at the position taken at the time, the workpiece can be held in a pressed state.

On the other hand, in a case where upon forming a workpiece the slide 9 is being allowed to ascend from a lower dead point, in the servo valve assembly 8 the main valve 8*a* will be switched to its ascending position by the pilot switching valve 8*b*, and the logic valve 14 will be turned ON and the logic valve 15 will be turned OFF by the electromagnetic valve 16.

Figure 4A:
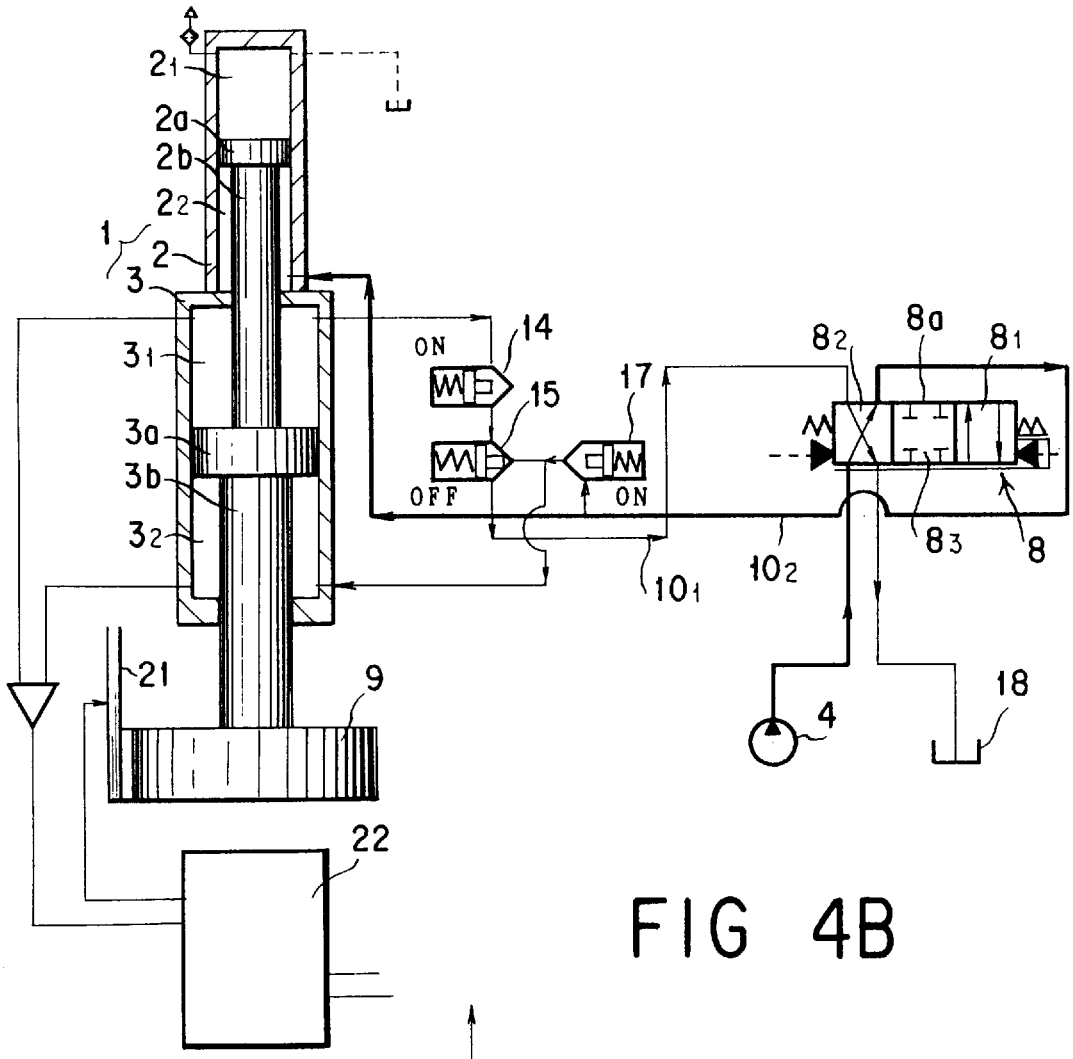
FIGS. 4A and 4B together represent an explanatory view that illustrates an operation in which the slide is allowed to ascend at a reduced speed according to the above noted first embodiment of the present invention.

This will, as shown in FIG. 4A, cause the pressure fluid discharged from the fluid pressure source 4 to be supplied into the lower chamber $\mathbf{2}_2$ of the subsidiary cylinder unit 2 through the conduit line $\mathbf{10}_2$ and into the lower chamber $\mathbf{3}_2$ of the principal cylinder unit 3 via the logic valve 17 while permitting the fluid in the upper chamber $\mathbf{3}_1$ of the principal cylinder 3 to be drained into the reservoir 18 through the conduit line $\mathbf{10}_1$.

Figure 4B:
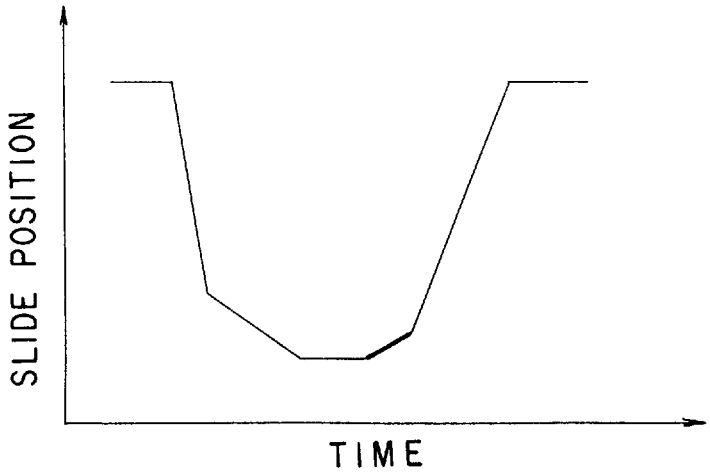

This will in turn cause the slide 9 to rise at a reduced speed as shown by the thick line in FIG. 4B. Then, since a lifting force of the principal cylinder unit 3 is added to the lifting force of the subsidiary cylinder unit 2, it may be seen that even where there is a bite of the upper die into the workpiece during a given forming operation, the bitted upper die can be intensively detached from the workpiece.

Figure 5A:
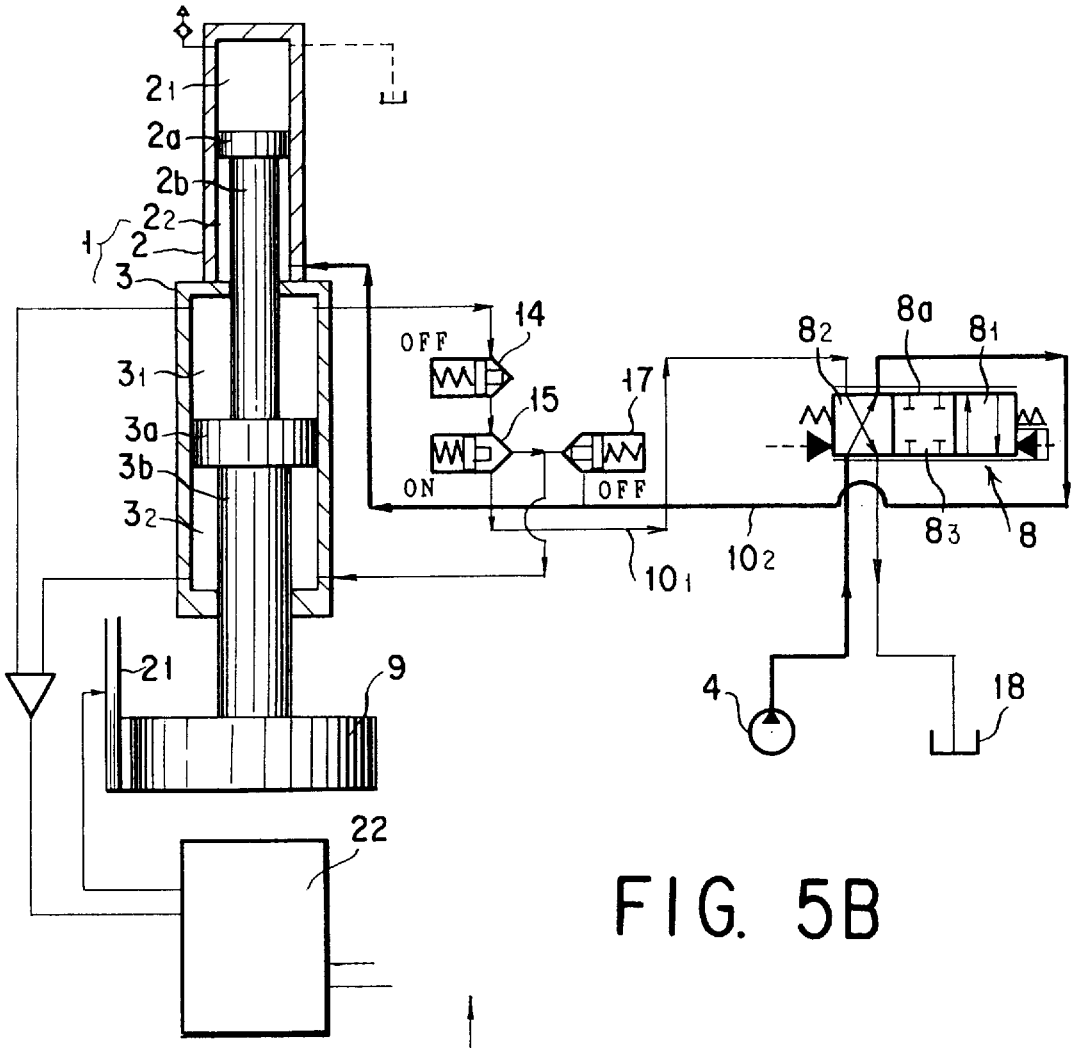
FIGS. 5A and 5B together represent an explanatory view that illustrates an operation in which the slide is allowed to ascend at an increased speed according to the above noted first embodiment of the present invention.
Figure 5B:
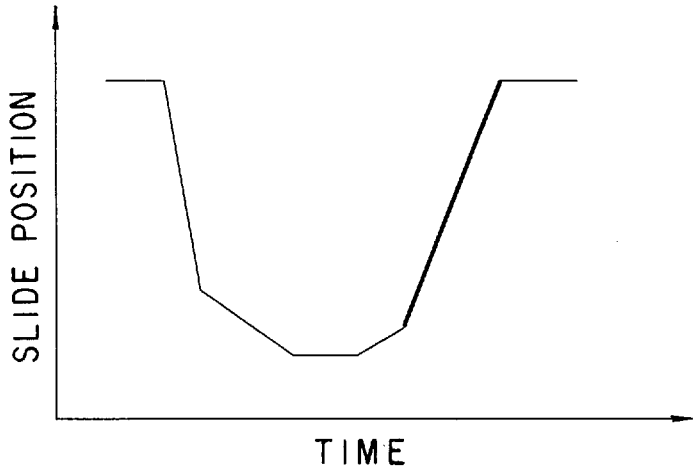
Figure 6:
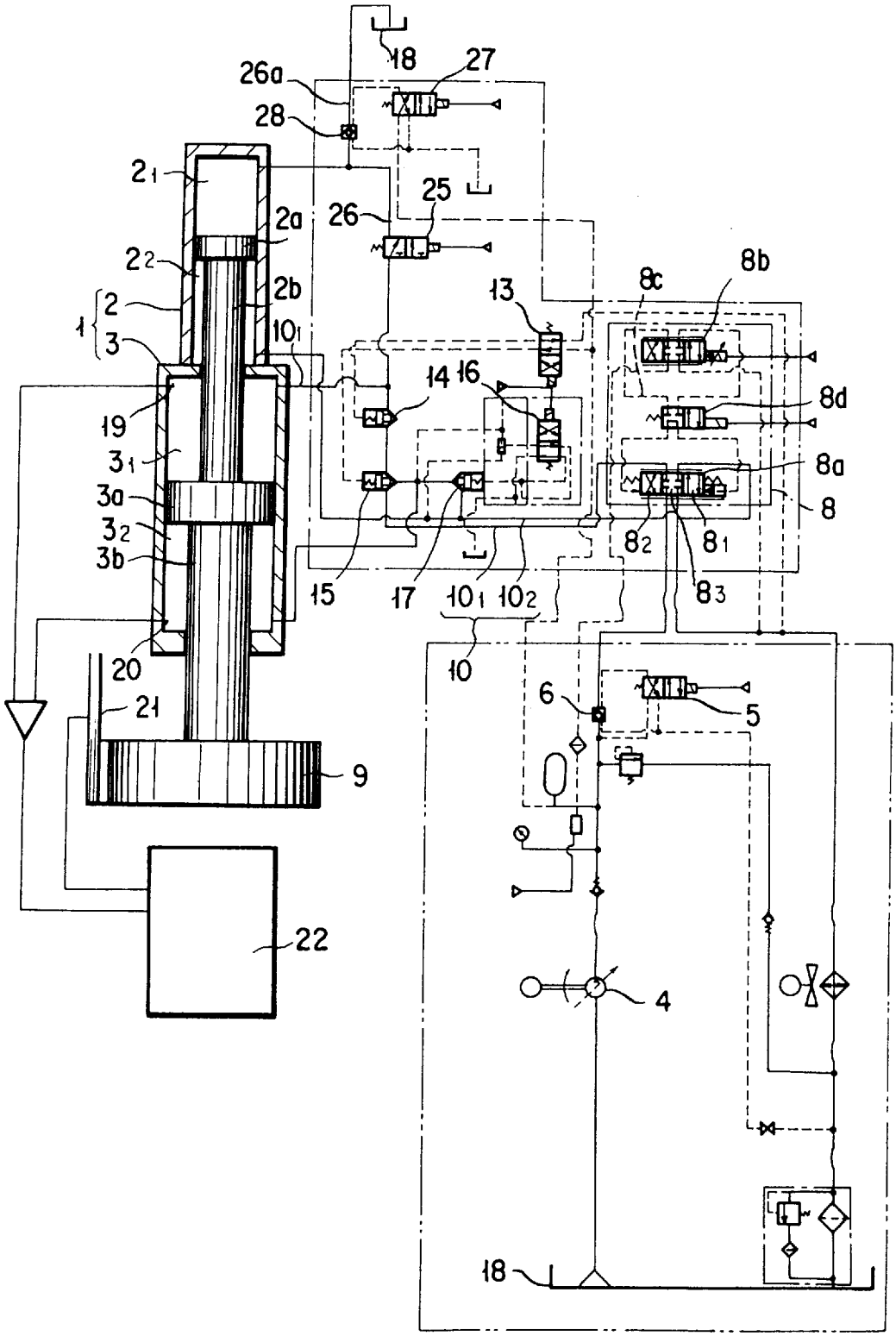
FIG. 6 is a circuit diagram that illustrates a second embodiment of the high speed safety circuit arrangement for a hydraulic press according to the present invention.

Thereafter, in the state in which the main valve 8*a* in the servo valve assembly 8 is held at its ascending position $\mathbf{8}_2$, the logic valve 14 will be turned OFF and the logic valve 15 will be turned ON by the electromagnetic valve 13, and the logic valve 17 will be turned OFF by the electromagnetic valve 16. This will, as shown in FIG. 5A, cause the pressure of the fluid discharged from the fluid pressure source 4 to be applied via the conduit line $\mathbf{10}_2$ to the lower chamber $\mathbf{2}_2$ of the subsidiary cylinder unit 2, the pressure fluid in the upper chamber $\mathbf{3}_1$ of the principal cylinder 3 to flow via the logic valves 14 and 15 into its lower chamber $\mathbf{3}_2$, an excessive amount of the fluid produced from the upper chamber $\mathbf{3}_1$ due to a difference in the pressure receiving area between the chambers $\mathbf{3}_1$ and $\mathbf{3}_2$ to be drained through the conduit line $\mathbf{10}_1$ into the reservoir 18. As a result, the slide 9 will be allowed to ascend rapidly up to its upper dead point as shown by the thick line in FIG. 5B.

The foregoing is a description of a series of normal operations as far as the first embodiment of the present invention is concerned in which there are provided a meter-in side circuit and a meter-out side circuit independently of each other and in which the meter-in side circuit is provided with the pilot check valve 6 and the servo valve assembly 8 whereas the meter-out circuit is provided with the logic valves 15 and 17 operating as a counter-balance valve and the servo valve assembly 8.

There is also provided the ON/OFF valve 8*d* that consists of an electromagnetic valve between the main valve 8*a* and the pilot switching valve 8*b* in the servo valve assembly 8.

This will, if either the electromagnetic valve 13 or 16 comes into a failure, allow the slide 9 to be stopped safely by the other electromagnetic valve 13 or 16 coupled with the servo valve assembly 8 and at the same time will, when the hydraulic pressure fluid happens to act abnormally, allow the main valve 8*a* in the servo valve assembly 8 to be returned to its neutral position without fail by turning the ON/OFF valve 8*d* OFF. Hence there will develop a doubled safety function that can operate. Als, where the main valve 8*a* comes to fail, it may be seen that the slide 9 can be stopped by turning the electromagnetic valves 5, 13 and 16 OFF.

It should be noted at this point that while not shown in the above noted first embodiment of the present invention, the logic valves 14, 15 and 17 are actually provided in a manifold block that is directly attached to the body of the cylinder assembly 1 so that it may be made unnecessary to provide a special piping unit externally installed to reduce the pressure loss and that it may also be easy to make a maintenance for these logic valves.

It should also be noted that the logic valves 14 and 15 are connected in series and are of an identical size and one of them 14 is used to effect a pressure compensation in the hydraulic circuit.

More specifically, assuming that the volume which varies as the elements of the logic valve 14 are displaced from the state in which the relationship of PVn=const. applies is expressed as Δ V and the pressure P and the volume V before and after the displacement of the elements are expressed as P1, V1; P2, V2, respectively, $$P1V1^n=P2V2^n,\ V2=V1-\Delta V$$

Therefore, $$P2=P1V1^n/(V1-\Delta V)^n\ (>P1)$$

As may be noted, this can prevent a shock from being generated due to a sudden change in the pressure because the logic valve 14 that is turned ON and OFF alternately with the logic valve 15 can be pressure compensated for a change in the volume produced when the logic valve 15 is turned ON and OFF.

FIGS. 6 through 10B show a second embodiment of the present invention.

It should be noted here that while the second embodiment is described, the same components as used in the first embodiment will have the same reference characters and the explanation of their details will be omitted.

While in the first embodiment the upper chamber $\mathbf{2}_1$ of the subsidiary cylinder unit 2 is opened to the atmosphere, in the second embodiment the upper chamber $\mathbf{2}_1$ and the lower chamber $\mathbf{2}_2$ of the subsidiary cylinder unit 2 are interconnected by a fluid conduit 26 with an electromagnetic valve 25 provided midway thereof. And, the conduit line 26 connected to the upper chamber $\mathbf{2}_1$ is further branched with a branching conduit line 26*a* being connected to the reservoir 18 via a pilot check valve 28 that is turned ON and OFF by an electromagnetic valve 27.

Next, an explanation will be given with respect to an operation of the above described second embodiment with to FIGS. 7A through 10B.

In a case where the slide 9 is being allowed to descend from its upper dead point to initiate a given pressing operation, the pilot switching valve 8*b* and the ON/OFF valve 8*d* in the servo valve assembly 8 will be turned ON to switch the main valve 8*a* from its neutral position $\mathbf{8}_3$ to its descending position $\mathbf{8}_1$. At the same time, the logic valve 14 will be turned OFF and the logic valve 15 will be turned ON by the electromagnetic valve 13, the logic valve 17 will be turned OFF by the electromagnetic valve 16, the electromagnetic valve 25 will be turned OFF, and the pilot check valve 28 will be turned ON by the electromagnetic valve 27.

Figure 7A:
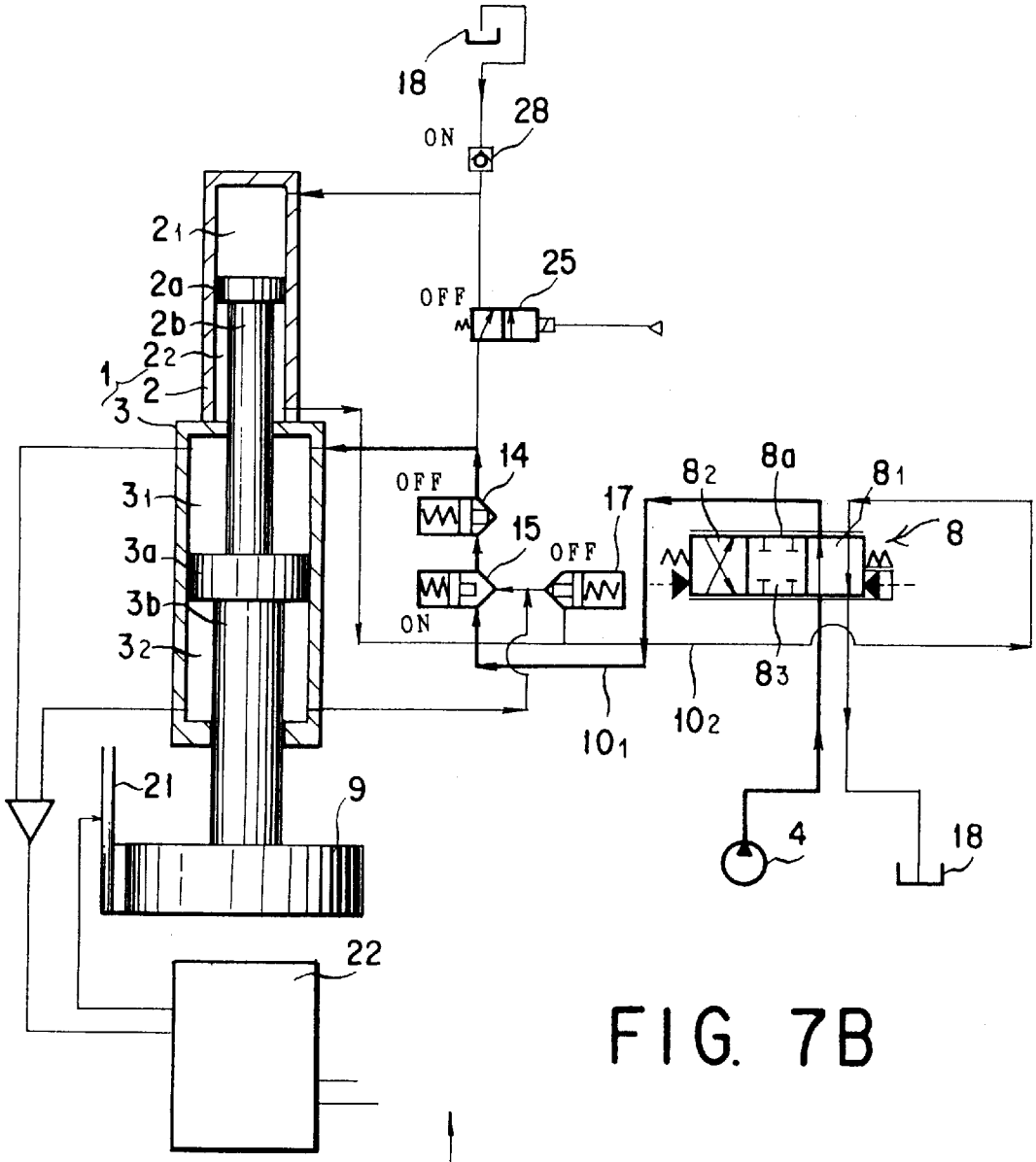
FIGS. 7A and 7B together represent an explanatory view that illustrates an operation in which the slide is allowed to descend at an increased speed according to the above noted second embodiment of the present invention.
Figure 7B:
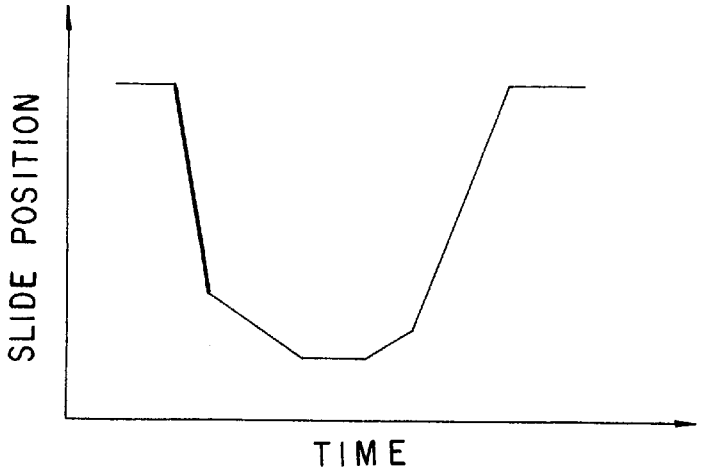

This will, a shown in FIG. 7A, cause the pressure fluid discharged from the fluid pressure source 4 to flow through the conduit line $\mathbf{10}_1$ into the upper chamber $\mathbf{3}_1$ of the principal cylinder unit 3 via the logic valves 15 and 14. Also, since the upper chamber $\mathbf{3}_1$ and the lower chamber $\mathbf{3}_2$ are interconnected via the logic valves 14 and 15, the slide 9 will be allowed to descend at an increased speed as shown by the thick line in FIG. 7B owing to a difference in the pressure receiving area between the upper chamber $\mathbf{3}_1$ and the lower chamber $\mathbf{3}_2$ of the principal cylinder unit 3. Then, the fluid in the lower chamber $\mathbf{2}_2$ of the subsidiary cylinder unit 2 will be drained through the conduit line $\mathbf{10}_2$ into the reservoir 18 via the servo valve assembly 8 and also the fluid in the reservoir 18 will be sucked into the upper chamber $\mathbf{2}_1$ of the subsidiary cylinder unit 2 via the pilot check valve 28.

Next, in a case where the slide 9 has been lowered to a predetermined position and a given pressing force is required to form a workpiece, it may be seen that with the main valve 8*a* held at its descending position $\mathbf{8}_1$ in the servo valve assembly 8, the logic valve 14 will be turned ON and the logic valve 15 will be turned OFF by the electromagnetic valve 13, the logic valve 17 will be turned ON by the electromagnetic valve 16, the electromagnetic valve 25 will be turned ON, and the pilot check valve 28 will be turned OFF by the electromagnetic valve 27.

Figure 8A:
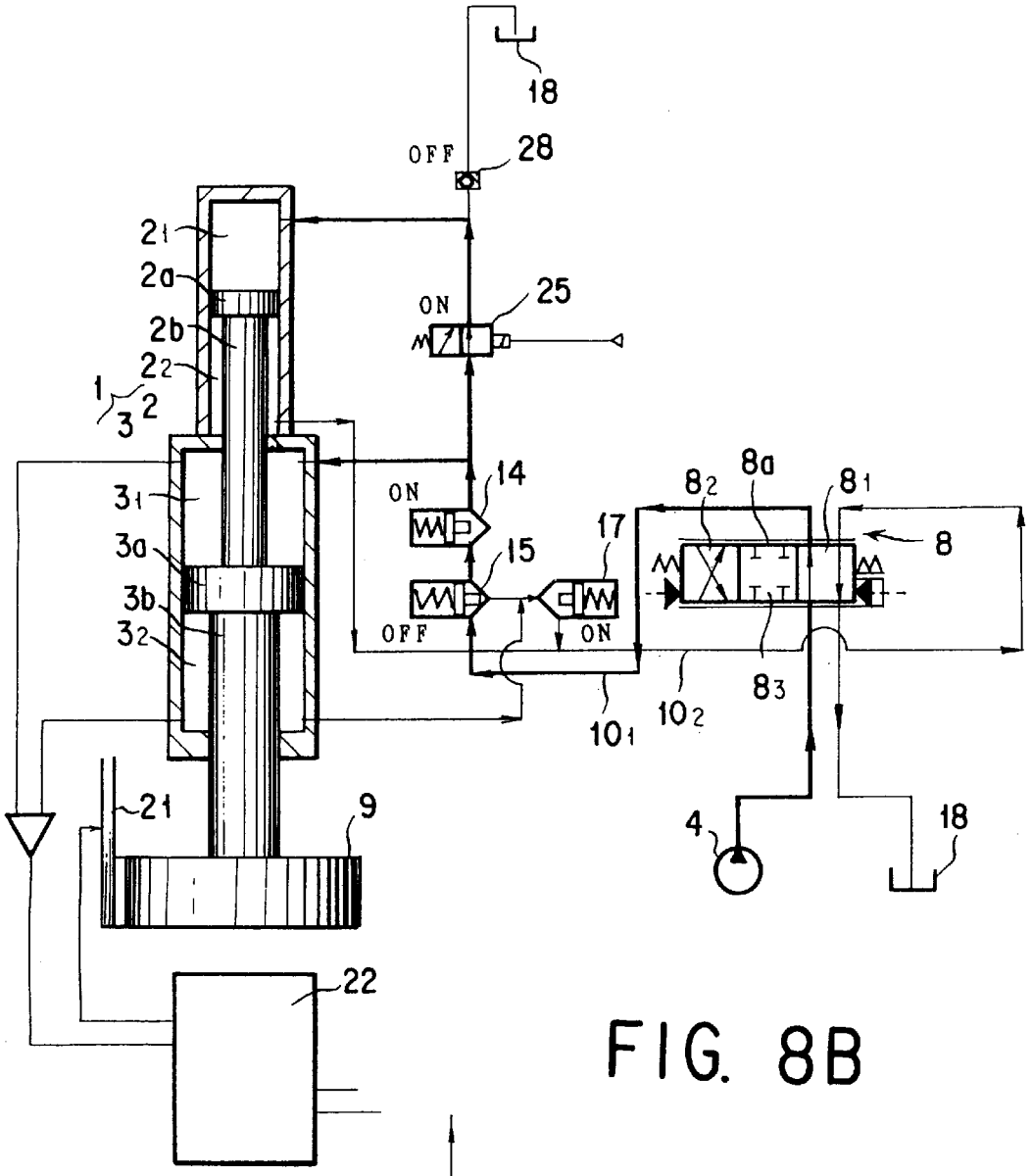
FIGS. 8A and 8B together represent an explanatory view that illustrates an operation in which the slide is allowed to descend at a reduced speed according to the above noted second embodiment of the present invention.
Figure 8B:
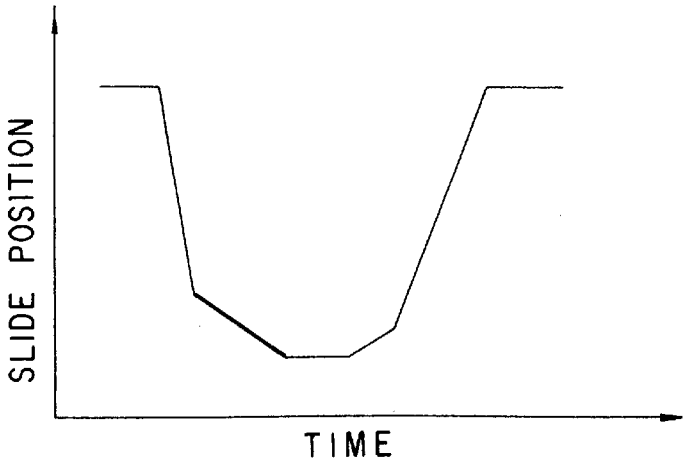

This will, as shown in FIG. 8A, cause the pressure fluid discharged from the fluid pressure source 4 to be supplied via the logic valves 15 and 14 into the upper chamber $\mathbf{3}_1$ of the principal cylinder 3 and to be supplied via the electromagnetic valve 25 into the upper chamber $\mathbf{2}_1$ of the subsidiary cylinder unit 2, and the fluid in the lower chamber $\mathbf{3}_2$ of the principal cylinder 3 to flow out thereof into the conduit line $\mathbf{10}_2$ via the logic valve 17 and along with the fluid in the lower chamber $\mathbf{2}_2$ of the subsidiary cylinder 2 to be drained into the reservoir 18. As a result, the piston 3*a* will be pushed downwards under a pressure of the fluid in the upper chamber $\mathbf{3}_1$ of the principal cylinder unit 3 and the fluid in the upper chamber $\mathbf{2}_1$ of the subsidiary cylinder unit 2 to cause the slide 9 to descend at a reduced speed as shown by the thick line in FIG. 8B. Then, an increased pressing force will be generated to allow a workpiece to be formed between the upper die and the lower die (none of them shown).

Also, in a case where the workpiece is required to be held in a pressurized state during a given forming operation, the main valve 8*a* in the servo valve assembly 8 will be switched to its neutral position $\mathbf{8}_3$ by the pilot switching valve 8*b* to cause the slide 9 to be stopped at the position taken at the time to hold the workpiece in the state in which it is pressed.

On the other hand, in a case where upon forming the workpiece the slide 9 is being allowed to ascend from its lower dead point, the main valve 8*a* in the servo valve assembly 8 will be switched to its ascending position $\mathbf{8}_2$ by the pilot switching valve 8*b*, the electromagnetic valve 25 will be turned ON and with the pilot check valve 28 held OFF the logic valve 17 will be turned ON by the electromagnetic valve 16 and the logic valve 14 will be turned ON and the logic valve 15 will be turned OFF by the electromagnetic valve 13.

Figure 9A:
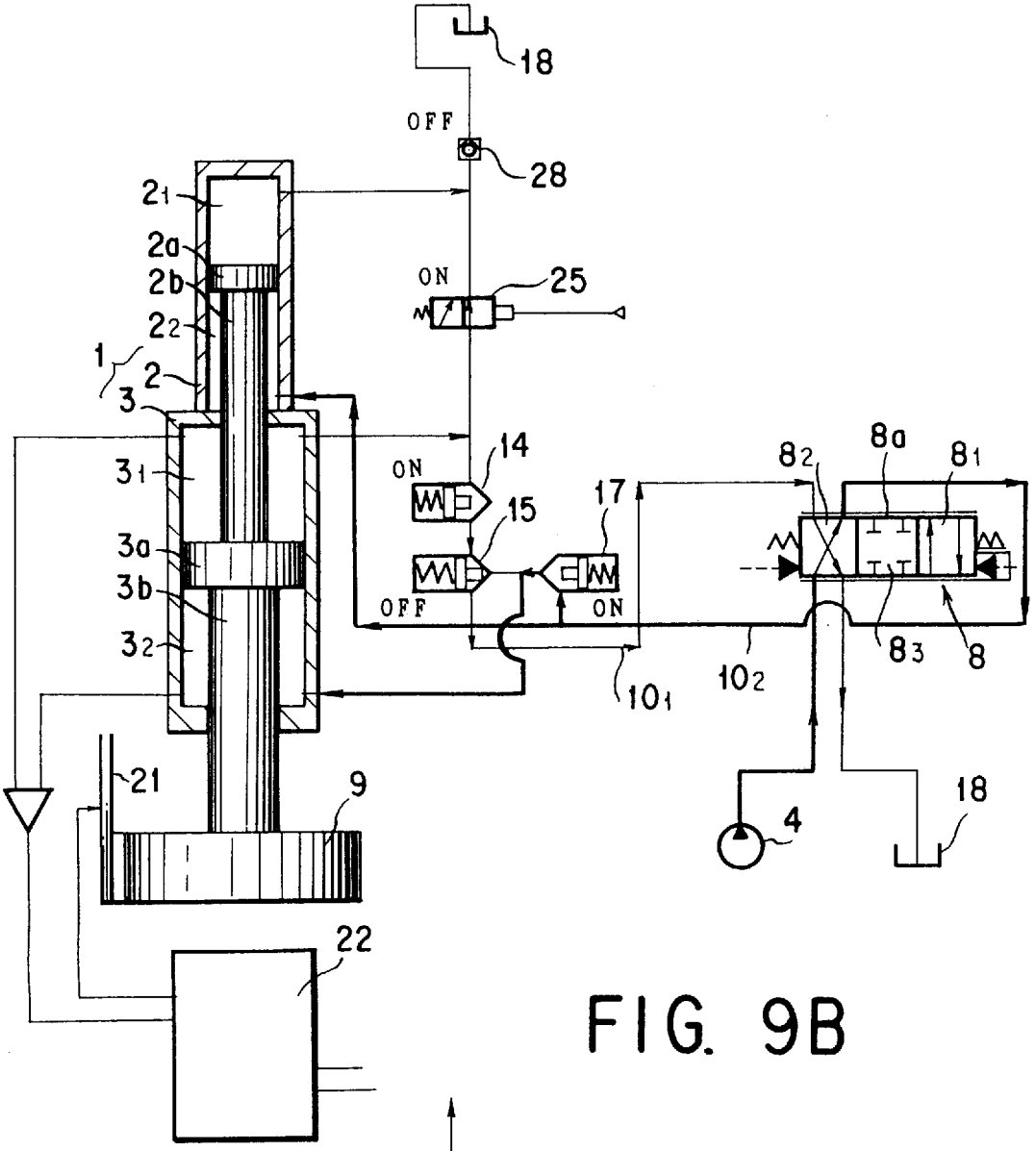
FIGS. 9A and 9B together represent an explanatory view that illustrates an operation in which the slide is allowed to ascend at a reduced speed according to the above noted second embodiment of the present invention.

This will, as shown in FIG. 9A, cause the pressure fluid discharged from the fluid pressure source 4 to be supplied through the conduit line $\mathbf{10}_2$ into the lower chamber $\mathbf{2}_2$ of the subsidiary cylinder unit 2 and to be supplied via the logic valve 17 into the lower chamber $\mathbf{3}_2$ of the principal cylinder unit 3 and allow the fluid in the upper chamber $\mathbf{2}_1$ and the fluid in the upper chamber $\mathbf{3}_1$ of the principal chamber 3 to be drained through the conduit line $\mathbf{10}_1$ into the reservoir 18.

Figure 9B:
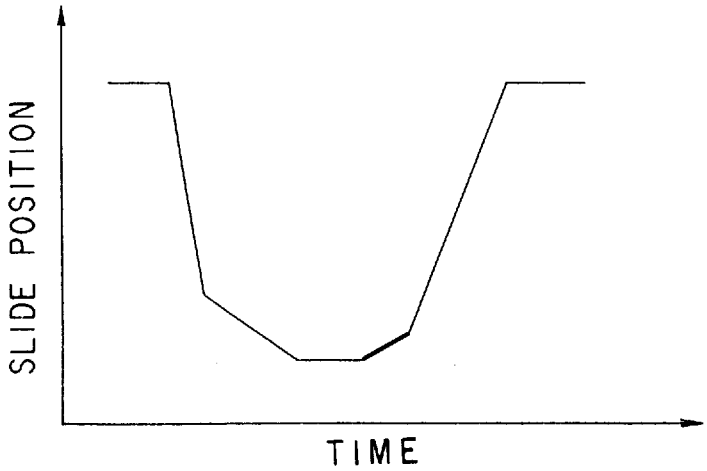

This will in turn cause the slide 9 to ascend at a reduced speed as shown by the thick line in FIG. 9B. Then, since a lifting force of the principal cylinder unit 3 is added to the lifting force of the subsidiary cylinder unit 2, it may be seen that even where there is a bite of the upper die into the workpiece during a given forming operation, the bitted upper die can be intensively detached from the workpiece.

Figure 10A:
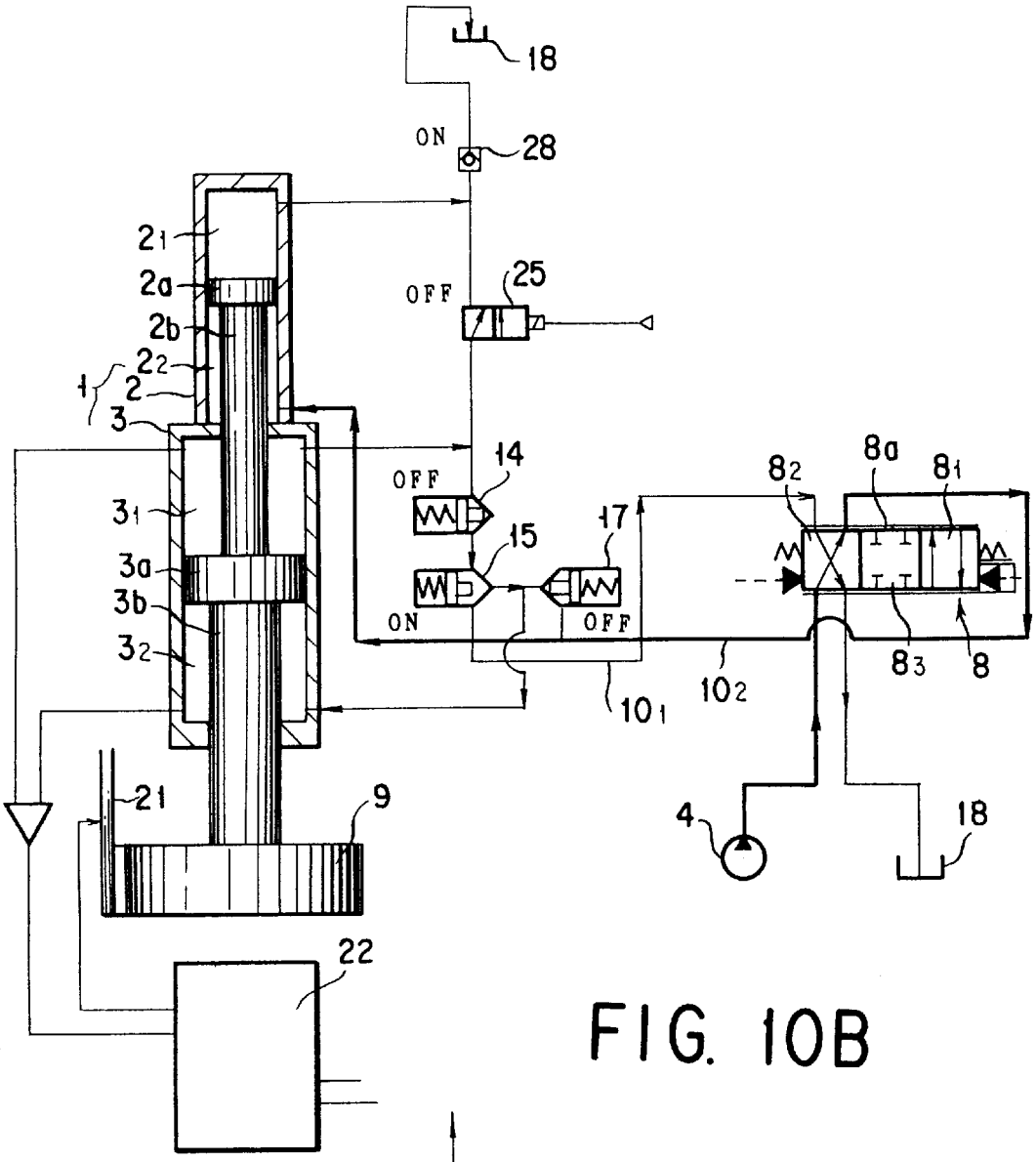
FIGS. 10A and 10B together represent an explanatory view that illustrates an operation in which the slide is allowed to ascend at an increased speed according to the above noted second embodiment of the present invention.
Figure 10B:
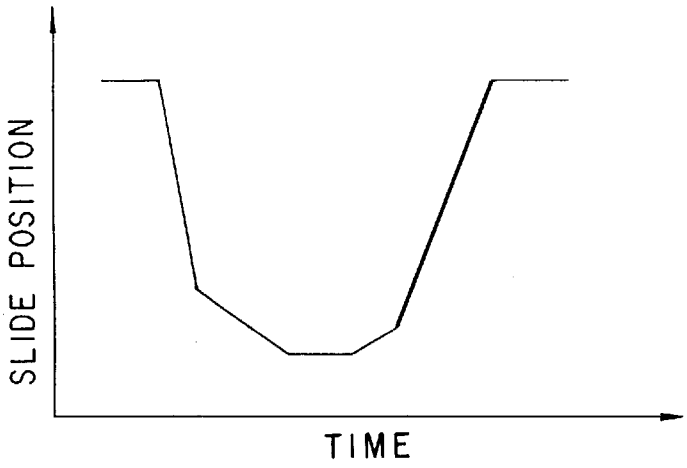
Figure 11:
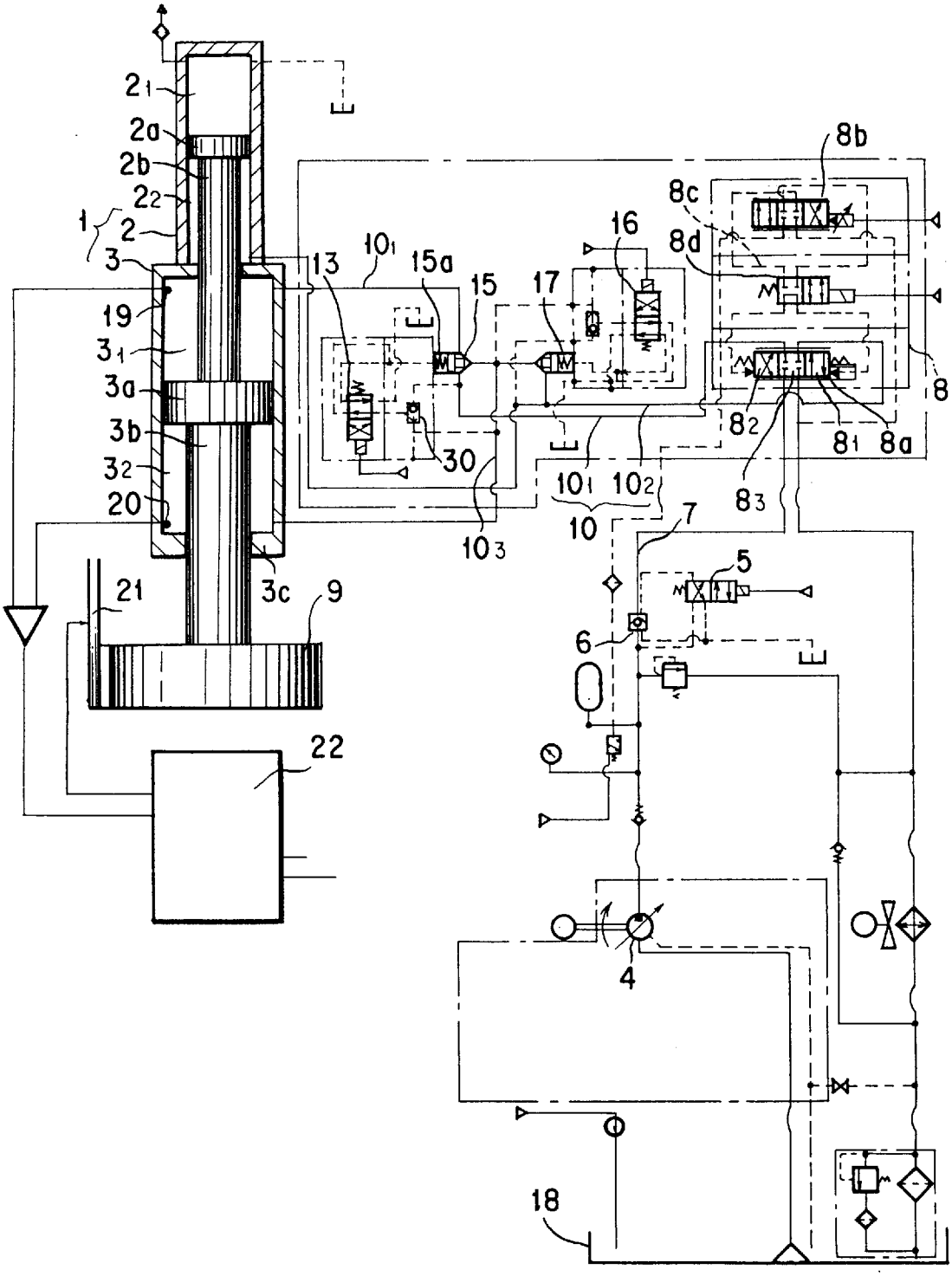
FIG. 11 is a circuit diagram that illustrates a third embodiment of the high speed safety circuit arrangement for a hydraulic press according to the present invention.

Thereafter, in the state in which the main valve 8*a* in the servo valve assembly 8 is held at its ascending position $\mathbf{8}_2$, the logic valve 14 will be turned OFF and the logic valve 15 will be turned ON by the electromagnetic valve 13, the electromagnetic valve 25 will be turned OFF, the pilot check valve 28 will be turned ON, and the logic valve 17 will be turned OFF by the electromagnetic valve 16. This will, as shown in FIG. 10A, cause the pressure of the fluid discharged from the fluid pressure source 4 to be applied via the conduit line $\mathbf{10}_2$ to the lower chamber $\mathbf{2}_2$ of the subsidiary cylinder unit 2, the pressure fluid in the upper chamber $\mathbf{3}_1$ of the principal cylinder 3 to flow via the logic valves 14 and 15 into its lower chamber $\mathbf{3}_2$, an excessive amount of the fluid produced from the upper chamber $\mathbf{3}_1$ due to a difference in the pressure receiving area between the chambers $\mathbf{3}_1$ and $\mathbf{3}_2$ to be drained through the conduit line $\mathbf{10}_1$ into the reservoir 18 and the fluid in the upper chamber $\mathbf{2}_1$ of the subsidiary cylinder 2 to be drained via the pilot check valve 28 into the reservoir 18. As a result, the slide 9 will be allowed to ascend rapidly up to its upper dead point as shown by the thick line in FIG. 10B.

It should be noted at this point that while in both the first and second embodiments of the present invention, by turning ON and OFF the logic valves 14 and 15 alternately which are of an identical size and are connected in series with each other a change in pressure generated when one of them 15 is turned ON and OFF is compensated for with the other of them 14, it is also possible to effect a pressure compensation for the logic valve 15 without using the logic valve 14 in such a circuit as a third embodiment of the present invention that will be described below.

FIGS. 11 through 15 show the third embodiment of the present invention. This embodiment is designed to dispense with the logic valve 14 for the purpose of such a pressure compensation and then to introduce the pressure fluid at a high pressure acting as a back pressure medium into the logic valve 14 by a shuttle valve 30.

More specifically, the logic valve 15 that is provided in the conduit line $\mathbf{10}_1$ communicating with the upper chamber of the principal cylinder unit 3 will be turned ON and OFF while the pressure fluid flowing at an increased pressure through the conduit lines $\mathbf{10}_1$ and $\mathbf{10}_3$ is introduced via the above mentioned electromagnetic valve 13 as a back pressure medium to a spring chamber 15*a* of the logic valve 15 by the shuttle valve 30 that is connected to the conduit line $\mathbf{10}_1$ and to a conduit line $\mathbf{10}_3$ which is designed to interconnect the logic valve 15 and the lower chamber $\mathbf{3}_2$ of the principal cylinder unit 3.

Next, with reference to FIGS. 12A through 15B an explanation will be given with respect to an operation of the third embodiment constructed as described above of the present invention.

In a case where the slide 9 is being allowed to descend from its upper dead point to initiate a given pressing operation, first the pilot switching valve 8*b* and the ON/OFF valve 8*d* in the servo valve assembly 8 will be turned to switch the spool 8*a* from its neutral position $\mathbf{8}_3$ to its descending position $\mathbf{8}_1$. At the same time, the logic valve 15 will be turned ON by the electromagnetic valve 13 and the logic valve 17 will be turned OFF by the electromagnetic valve 16.

Figure 12A:
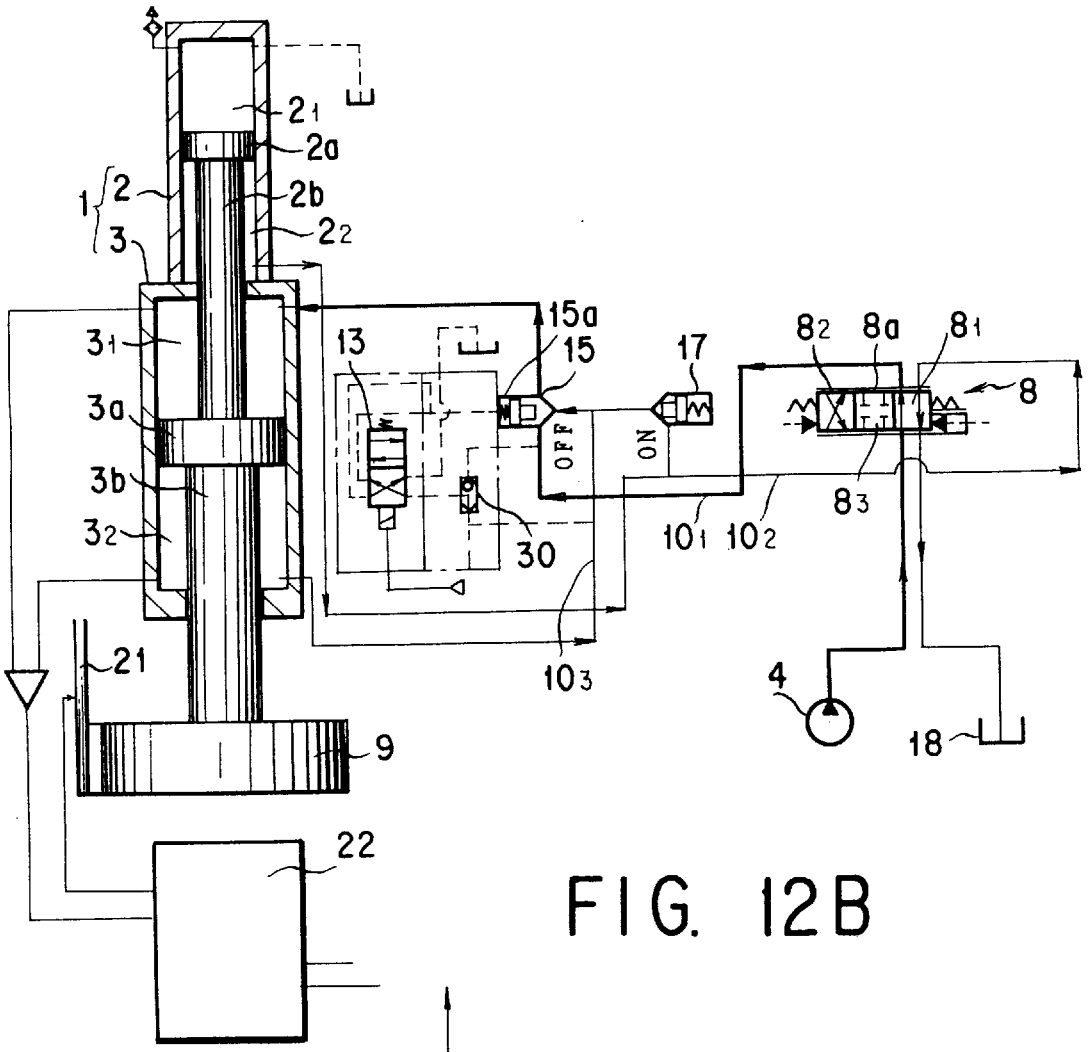
FIGS. 12A and 12B together represent an explanatory view that illustrates an operation in which the slide is allowed to descend at an increased speed according to the above noted third embodiment of the present invention.
Figure 12B:
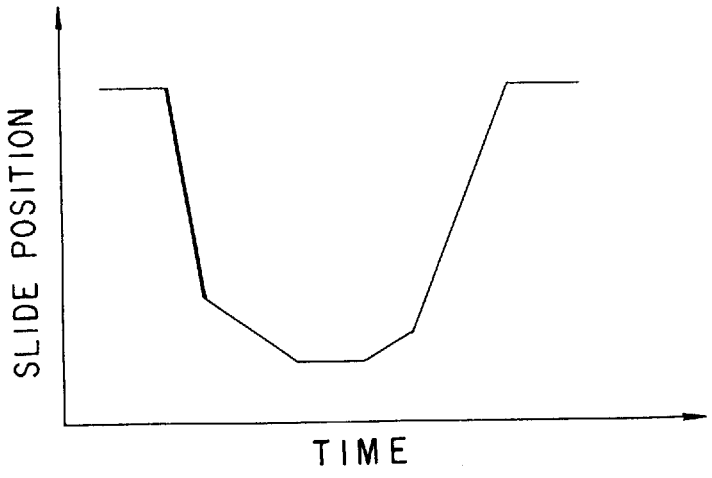

This will, as shown in FIG. 12A, cause the pressure fluid discharged from the fluid pressure source 4 to flow through the conduit line 10 into the upper chamber $\mathbf{3}_1$ of the principal cylinder unit 3 via the logic valve 15. Also, the upper chamber $\mathbf{3}_1$ and the lower chamber $\mathbf{3}_2$ are interconnected via the logic valve 15. Accordingly the slide 9 will be allowed to descend at an increased speed as shown by the thick line in FIG. 12B owing to a difference in the pressure receiving area between the upper chamber $\mathbf{3}_1$ and the lower chamber $\mathbf{3}_2$ of the principal cylinder unit 3. Then, the fluid in the lower chamber $\mathbf{2}_2$ of the subsidiary cylinder unit 2 will be drained through the conduit line $\mathbf{10}_2$ into the reservoir 18 via the servo valve assembly 8.

Next, in a case where the slide 9 has been lowered to a predetermined position and a given pressing force is required to form a workpiece, it may be seen that with the main valve 8*a* held at its descending position $\mathbf{8}_1$ in the servo valve assembly 8, the logic valve 15 will be turned OFF by the electromagnetic valve 13, and the logic valve 17 will be turned ON by the electromagnetic valve 16.

Figure 13A:
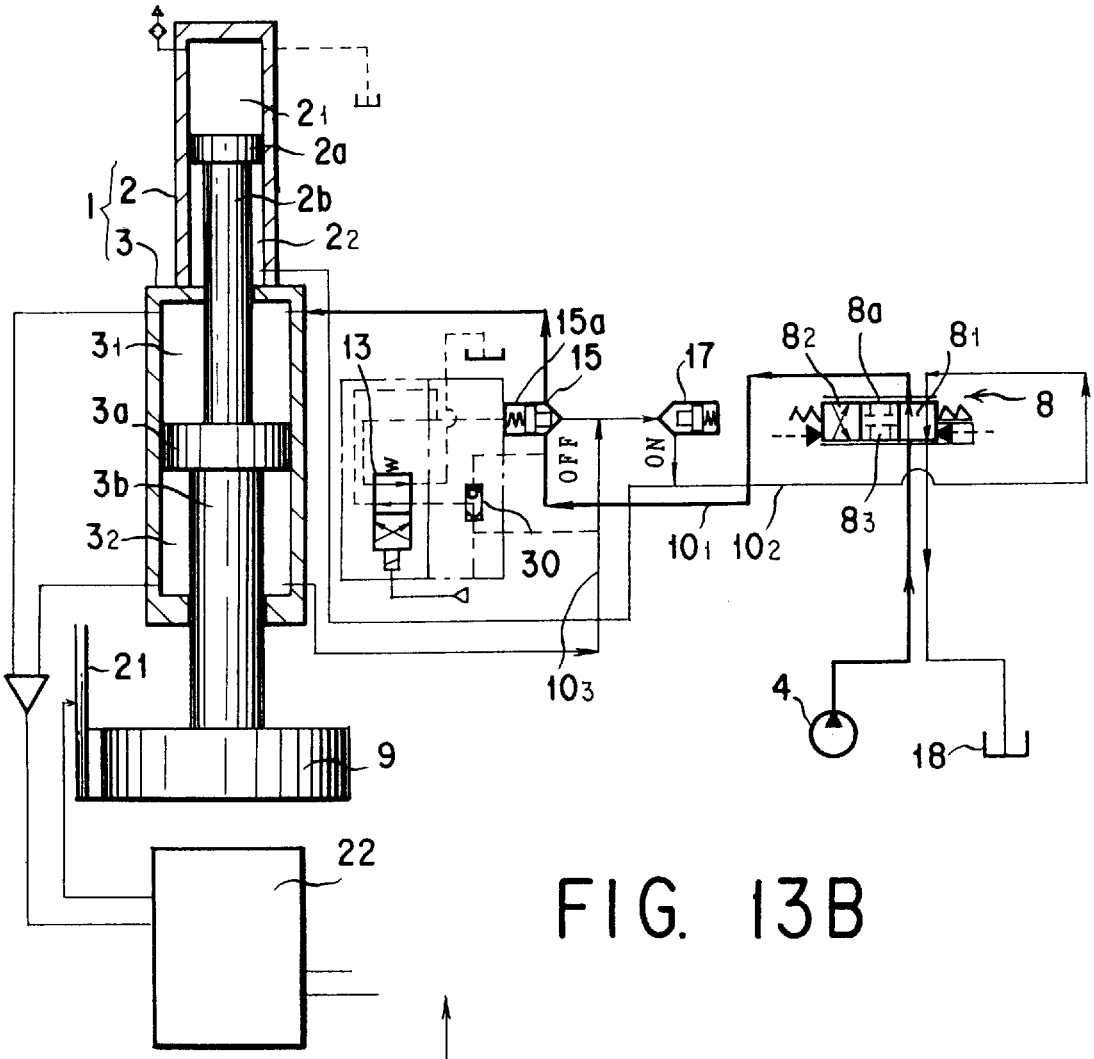
FIGS. 13A and 13B together represent an explanatory view that illustrates an operation in which the slide is allowed to descend at a reduced speed according to the above noted third embodiment of the present invention.
Figure 13B:
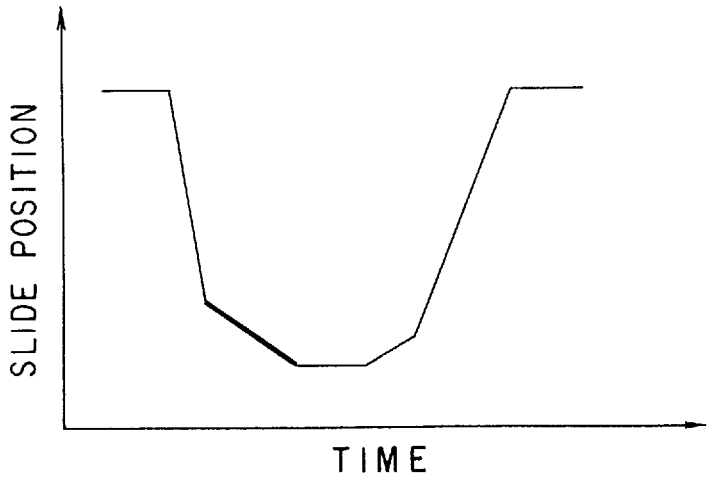

This will, as shown in FIG. 13A, cause the pressure fluid discharged from the fluid pressure source 4 to be supplied via the logic valve 15 only into the upper chamber $\mathbf{3}_1$ of the principal cylinder 3 and the fluid in the lower chamber $\mathbf{3}_2$ of the principal cylinder 3 to flow out thereof through the conduit line $\mathbf{10}_3$ into the conduit line $\mathbf{10}_2$ via the logic valve 17 and along with the fluid in the lower chamber $\mathbf{2}_2$ of the subsidiary cylinder 2 to be drained into the reservoir 18. As a result, the piston 3*a* will be pushed downwards under a pressure of the fluid in the upper chamber $\mathbf{3}_1$ of the principal cylinder unit 3 to cause the slide 9 to descend at a reduced speed as shown by the thick line in FIG. 13B. Then, an increased pressing force will be generated to allow a workpiece to be formed between the upper die and the lower die (none of them shown).

Also, in a case where the workpiece is required to be held in a pressurized state during a given forming operation, the main valve 8*a* in the servo valve assembly 8 will be switched to its neutral position $\mathbf{8}_3$ by the pilot switching valve 8*b* to cause the slide 9 to be stopped at the position taken at the time to hold the workpiece in the state in which it is pressed.

On the other hand, in a case where upon forming the workpiece the slide 9 is being allowed to ascend from its lower dead point, the main valve 8*a* in the servo valve assembly 8 will be switched to its ascending position $\mathbf{8}_2$ by the pilot switching valve 8*b*, the logic valve 17 will be turned ON by the electromagnetic valve 16, and the logic valve 15 will be turned OFF by the electromagnetic valve 13.

Figure 14A:
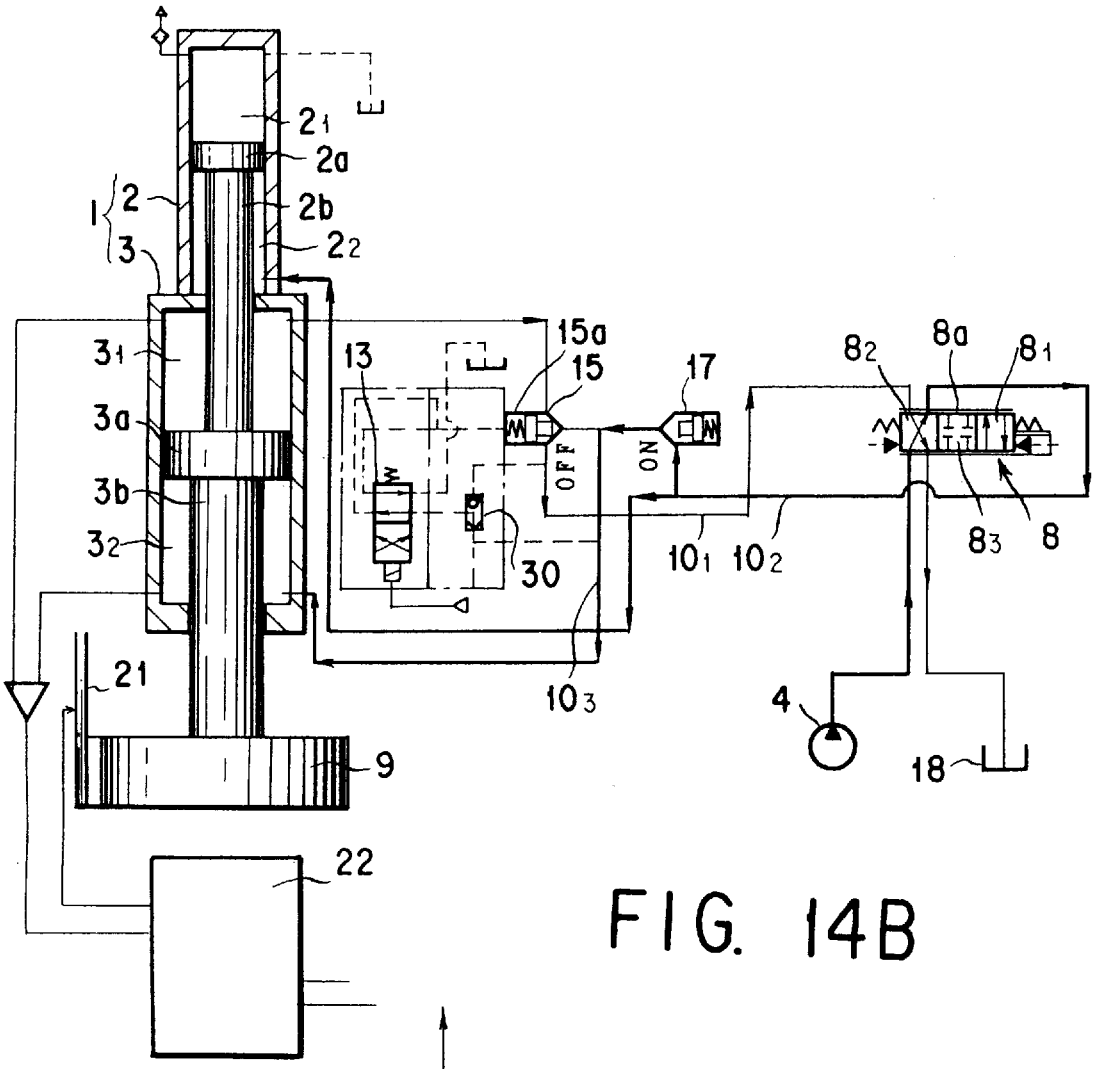
FIGS. 14A and 14B together represent an explanatory view that illustrates an operation in which the slide is allowed to ascend at a reduced speed according to the above noted third embodiment of the present invention.

This will, as shown in FIG. 14A, cause the pressure fluid discharged from the fluid pressure source 4 to be supplied through the conduit line $\mathbf{10}_2$ into the lower chamber $\mathbf{2}_2$ of the subsidiary cylinder unit 2 and to be supplied via the logic valve 17 through the conduit line $\mathbf{10}_3$ into the lower chamber $\mathbf{3}_2$ of the principal cylinder unit 3 and allow the fluid in the upper chamber $\mathbf{3}_1$ of the principal chamber 3 to be drained through the conduit line $\mathbf{10}_1$ into the reservoir 18.

Figure 14B:
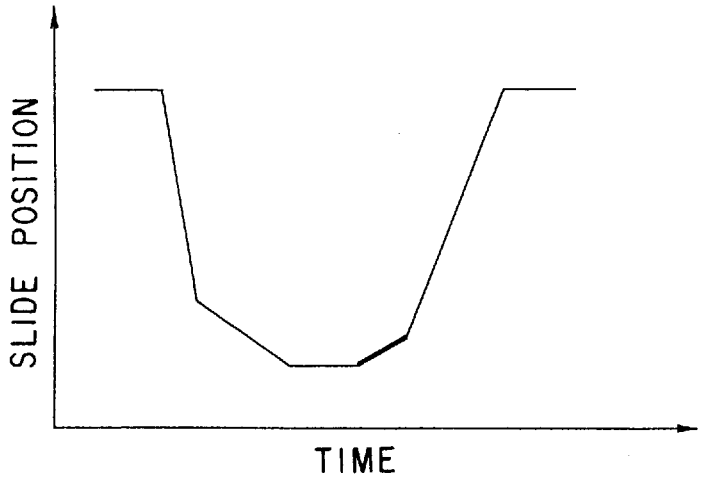
Figure 15A:
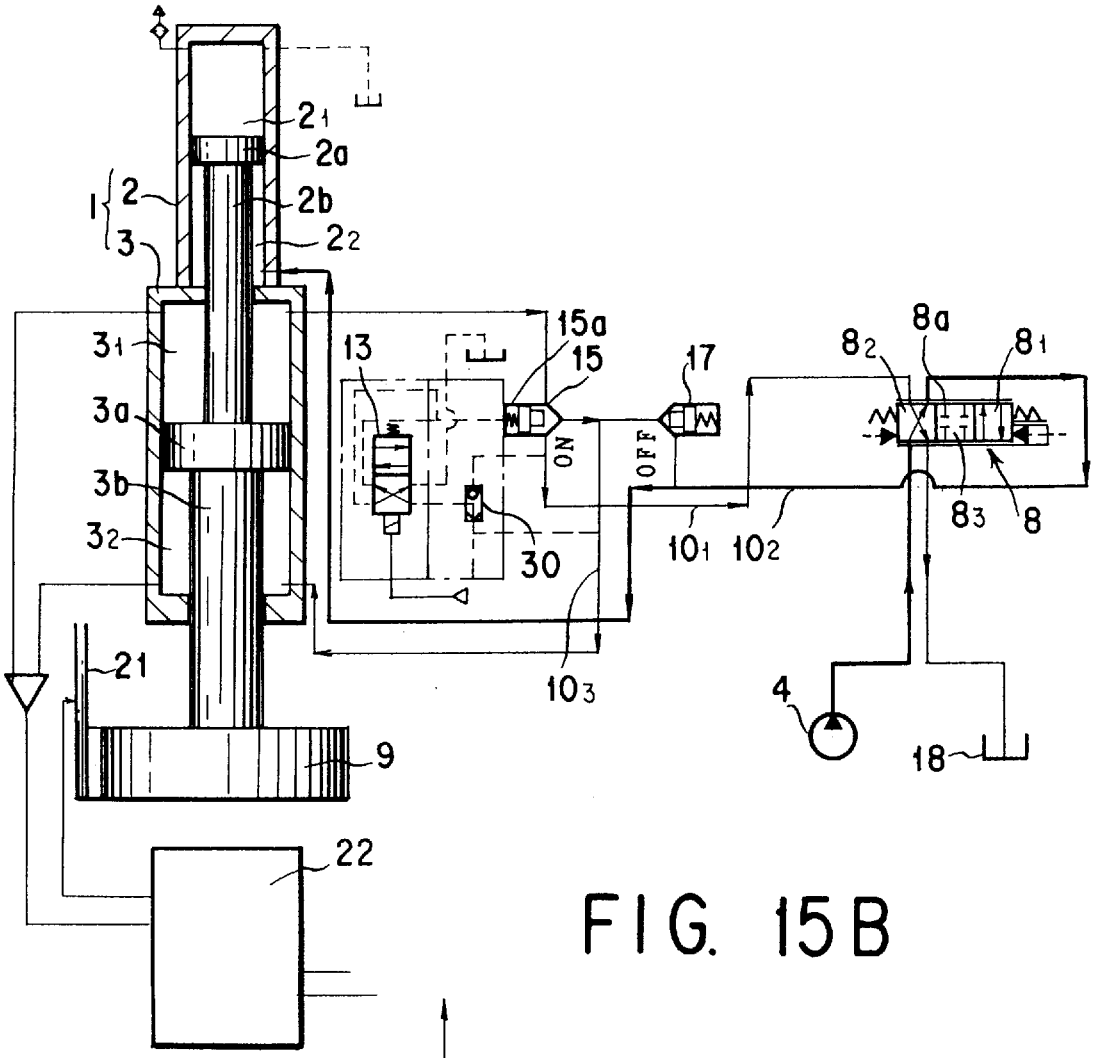
FIGS. 15A and 15B together represent an explanatory view that illustrates an operation in which the slide is allowed to ascend at an increased speed according to the above noted third embodiment of the present invention.
Figure 15B:
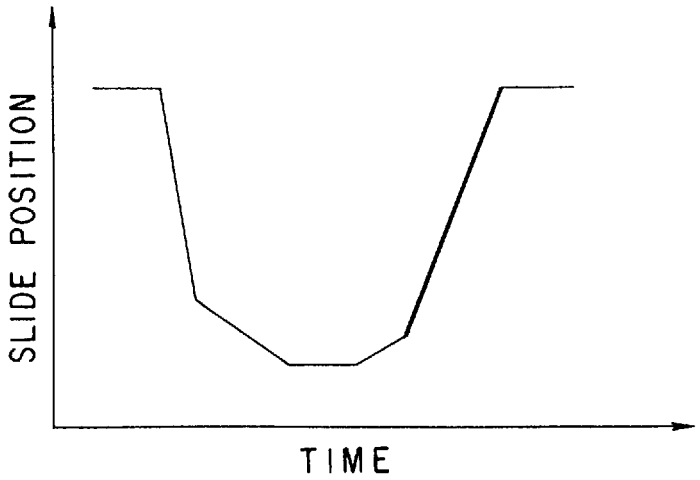

This will in turn cause the slide 9 to ascend at a reduced speed as shown by the thick line in FIG. 14B. Then, since a lifting force of the principal cylinder unit 3 is added to the lifting force of the subsidiary cylinder unit 2, it may be seen that even where there is a bite of the upper die into the workpiece during a given forming operation, the bitted upper die can be intensively detached from the workpiece.

Thereafter, in the state in which the main valve 8*a* in the servo valve assembly 8 is held at its ascending position $\mathbf{8}_2$, the logic valve 15 will be turned ON by the electromagnetic valve 13, and the logic valve 17 will be turned OFF by the electromagnetic valve 16. This will, as shown in FIG. 14A, cause the pressure of the fluid discharged from the fluid pressure source 4 to be applied via the conduit line $\mathbf{10}_2$ to the lower chamber $\mathbf{2}_2$ of the subsidiary cylinder unit 2, the pressure fluid in the upper chamber $\mathbf{3}_1$ of the principal cylinder 3 to flow via the logic valve 15 and through the conduit line $\mathbf{10}_3$ into its lower chamber $\mathbf{3}_2$, an excessive amount of the fluid produced from the upper chamber $\mathbf{3}_1$ due to a difference in the pressure receiving area between the chambers $\mathbf{3}_1$ and $\mathbf{3}_2$ to be drained through the conduit line $\mathbf{10}_1$ into the reservoir 18. As a result, the slide 9 will be allowed to ascend rapidly up to its upper dead point as shown by the thick line in FIG. 15B.

As described in the foregoing, it may be seen that even where the logic valve 14 designed to effect a pressure compensation is dispensed with as in this embodiment, a function same as in the first embodiment is obtainable. At the same time it may be seen that with the pressure fluid flowing at an increased pressure through the conduit lines $\mathbf{10}_1$ and $\mathbf{10}_3$ applied as a back pressure medium to the spring chamber 15*a* of the logic valve 15 via the shuttle valve 30, a change in pressure generated when the logic valve 15 is operated can be compensated for.

As set forth in the foregoing description in detail, it may be seen that according to one aspect of the present invention in which there being provided in a conduit line for supplying the pressure fluid to the hydraulic cylinder assembly from the source thereof with a servo valve assembly provided as controllable independently and a logic valve that is adapted to be turned ON and OFF by an electromagnetic valve, if a electromagnetic valve in one given conduit line fails to operate, an electromagnetic valve and a servo valve assembly in the other conduit line can be used to control the operation of the hydraulic cylinder assembly, thus permitting a press system to cease operating in safety.

Also, even where a servo valve assembly fails to operate, it can be restored to the neutral position without fail by blocking a pilot circuit to allow a press to cease operating. Thus, since the safety function is doubled to operate, the required safety is markedly enhanced. Further, with logic valves used which are of an identical size and are connected in series with each other for a pressure compensation, it can be prevented for a pressure from being suddenly elevated due to a change in volume as generated within a cylinder assembly when a logic valve is operated.

Further, if a pressure fluid at an increased pressure is applied as a back pressure medium to a logic valve, it may be seen that any other logic valve designed to effect a pressure compensation will be made unnecessary and hence be economical. At the same time, since a slide is allowed to ascend with a greater lifting force that is developed by both a principal and a subsidiary cylinder unit while it is ascending, any possible inconvenience arising from a bite of an upper die into a workpiece which makes it difficult for the former to be detached from the latter can be eliminated.

And also, if a logic valve is included in a manifold block directly attached to the body of a hydraulic cylinder assembly, it may be seen that not only it can be made unnecessary to provide a special piping unit externally installed to reduce any possible pressure loss and to enhance its maintainability but also the piston rod in the subsidiary cylinder unit is effectively prevented from projecting upwards and hence is safe.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. In a hydraulic press in which a slide is vertically driven by a hydraulic cylinder assembly having:

a principal cylinder unit and a subsidiary cylinder unit together constituting the hydraulic cylinder assembly and being arranged vertically down and up with a common center line therefor, said principal cylinder unit having a pressure receiving area which is greater than that of said subsidiary cylinder unit, and a piston in said principal cylinder unit and a piston in said subsidiary cylinder unit being connected together by a piston rod in said subsidiary cylinder unit that is smaller in diameter than a piston rod in said principal cylinder unit, a high speed safety circuit arrangement for said hydraulic press, which comprises:

a servo valve means disposed in one of at least a pair of conduit lines for supplying a pressure fluid from a source thereof into said principal cylinder unit and said subsidiary cylinder unit, respectively, and operable to switch the direction in which said pressure fluid is supplied;

a first electromagnetic valve means;

a first logic valve means disposed in the other of said conduit lines and adapted to be switched on and off in response to an operation of said servo valve means and said first electromagnetic valve means;

a second electromagnetic valve means; and a second and a third logic valve means of which each is adapted to be switched on and off in response to an operation of said second electromagnetic valve means and at least one is selectively actuatable thereby to interconnect an upper and a lower chamber of said principal cylinder unit in a hydraulic circuit.

2. A high speed safety circuit arrangement for the hydraulic press, as set forth in claim 1, further comprising:

a third electromagnetic valve; and a first pilot check valve means disposed midway in a conduit line interconnecting said pressure fluid source and said servo valve means and adapted to be switched on and off in response to an operation of said third electromagnetic valve means.

3. A high speed safety circuit arrangement for the hydraulic press, as set forth in claim 1, further comprising:

a fourth electromagnetic valve means for connecting the upper chamber in said principal cylinder unit and an upper chamber in said subsidiary cylinder unit with each other;

a fifth electromagnetic valve means; and a second check valve means adapted to be switched on and off in response to said fifth electromagnetic means for interconnecting the upper chamber of said subsidiary cylinder unit and a fluid reservoir via said second pilot check valve means.

4. A high speed safety circuit arrangement for the hydraulic press, as set forth in claim 1, in which said logic valve means for interconnecting the upper and lower chambers of said principal cylinder unit in the hydraulic circuit is constituted by said second and third logic valve means together which are connected in series with each other and substantially of an identical size, and said second and third logic valve means are adapted to be switched on and off alternately in response to an operation of said second electromagnetic means for effecting a pressure compensation in said hydraulic circuit.

5. A high speed safety circuit arrangement for the hydraulic press, as set forth in claim 1, in which said logic valve means for interconnecting the upper and lower chambers of said principal cylinder unit is constituted by said third logic valve means, further comprising:

a shuttle valve means for applying therethrough the pressure fluid as a back pressure medium to said third logic valve means at a high pressure side thereof for effecting a pressure compensation in said hydraulic circuit.

* * * * *